US007052106B1

(12) United States Patent
Onuma et al.

(10) Patent No.: US 7,052,106 B1
(45) Date of Patent: May 30, 2006

(54) PRINT HEAD RECOVERY

(75) Inventors: Kentaro Onuma, Irvine, CA (US); Tadashi Hanabusa, Kawasaki (JP); Tetsuhiro Nitta, Yokohama (JP); Hiromitsu Hirabayashi, Yokohama (JP); Shinji Kanemitsu, Irvine, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 1114 days.

(21) Appl. No.: 09/661,388

(22) Filed: Sep. 13, 2000

(51) Int. Cl.
*B41J 2/165* (2006.01)

(52) U.S. Cl. ..... 347/22; 347/29; 347/33

(58) Field of Classification Search ..... 347/29, 347/30, 32, 33, 22
See application file for complete search history.

(56) References Cited

U.S. PATENT DOCUMENTS

| | | | | |
|---|---|---|---|---|
| 5,610,641 | A | 3/1997 | Ikado | 347/33 |
| 5,712,668 | A | 1/1998 | Osborne et al. | 347/32 |
| 5,751,301 | A | 5/1998 | Saikawa et al. | 347/8 |
| 6,109,726 | A | 8/2000 | Lee | 347/33 |

FOREIGN PATENT DOCUMENTS

| | | |
|---|---|---|
| DE | 195 31 352 | 1/1996 |
| EP | 0 845 360 | 6/1998 |
| EP | 0 850 773 | 7/1998 |
| EP | 0 856 404 | 8/1998 |
| EP | 0 913 262 | 5/1999 |
| EP | 1 010 535 | 6/2000 |
| JP | 11-320915 | 11/1999 |
| JP | 2000-198211 | 7/2000 |

OTHER PUBLICATIONS

EP Search Report dated Feb. 4, 2002.
EP Search Report dated Apr. 26, 2002.

*Primary Examiner*—Stephen Meier
*Assistant Examiner*—Ly T. Tran
(74) *Attorney, Agent, or Firm*—Fitzpatrick, Cella, Harper & Scinto

(57) ABSTRACT

A printing device for performing recording on a recording medium, the printing device comprising a carriage slidably mounted on the printing device in a lateral direction to scan the recording medium, and movable in a vertical direction to a plurality of predetermined distances above the recording medium during printing, a print head mounted on the carriage, the print head having a discharge surface with a discharge nozzle located therein, the discharge nozzle for ejecting ink on the recording medium, and a recovery mechanism for performing recovery of the print head when the carriage is positioned above the recovery mechanism, the recovery mechanism including a carriage lever to engage the carriage and move the carriage in the vertical direction to a predetermined position above the recovery mechanism.

24 Claims, 32 Drawing Sheets

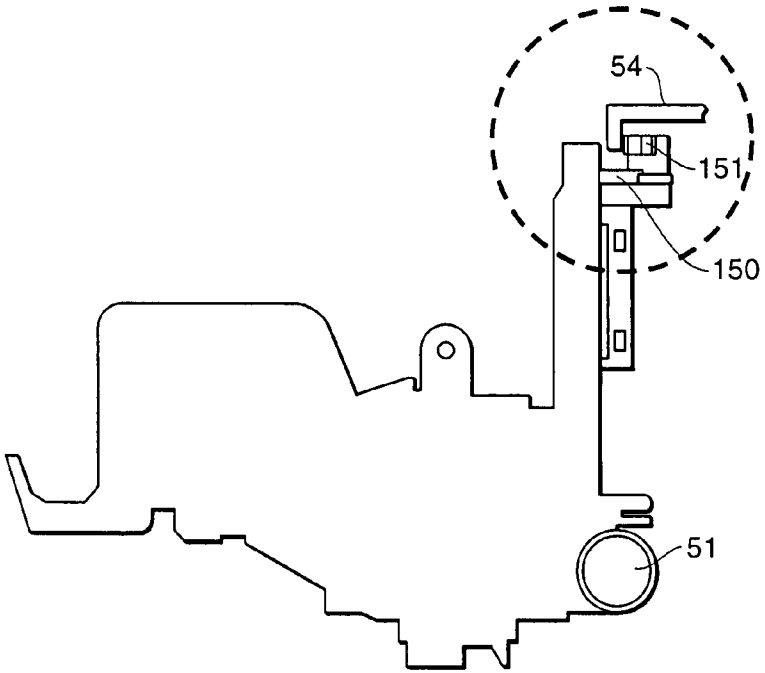
FIG. 16B
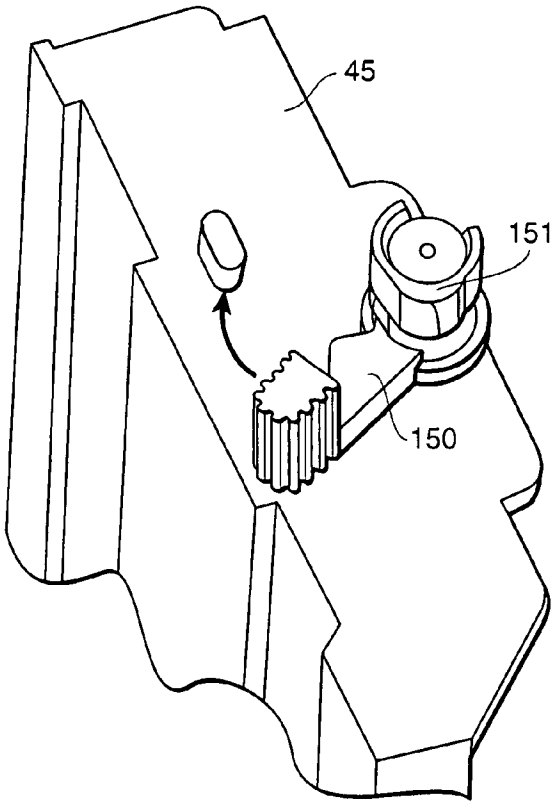
FIG. 16A
FIG. 16

PRINT HEAD RECOVERY

BACKGROUND OF THE INVENTION

1. Field of the Invention

The present invention relates to the improved recovery of a print head in a printing device for maintaining the print head in a good printing condition. More specifically, the present invention relates to an improved recovery of a print head in an ink jet printing device wherein the improved recovery includes accurate positioning of the print head during recovery operations, protection of the caps and wiper during non-use, concurrent prefiring and wiping operations, dampened print head capping, and improved wiping with a partitioned, multi-portion wiper blade.

2. Description of the Related Art

A printing device, such as an ink jet printer, prints images onto a printing medium, such as paper or other sheet of material, by scanning a carriage carrying a print head across the printing medium while ejecting ink from the print head. Specifically, the carriage is scanned in a main scanning direction which crosses the printing medium perpendicular to the conveying direction, which is the sub-scanning direction. As the carriage is moved in the main scanning direction across the printing medium, the print head ejects ink to produce an image portion corresponding to one line. After completion of the image portion corresponding to the one line, the printing medium is conveyed by a predetermined amount in the sub-scanning direction, after which the image portion corresponding to the next line is printed. These operations are repeated until the entire image is printed on the printing medium.

Such an ink jet printing device is advantageous because the device can be designed and built in a small size, and because it is possible to print a high-resolution image at a high speed on ordinary paper at a low running cost. In addition, such an ink jet printing device can enable the printing of a color image by using inks of different colors in the print head, or in multiple print heads, mounted on the carriage. Different combinations of ink can be utilized to achieve desired color images and resolutions. For example, multiple print heads using only black ink can be utilized for printing of text, and multiple print heads wherein one print head uses black ink and another print head uses a color ink can be utilized to create color images. Different types of ink may also be used for desired results. For example, the black and color inks may be made dye ink or pigment ink.

In addition, reaction inks may be used to accomplish quick fixing of the ink on the printing medium as it is ejected from the print heads. For example, one print head may be utilized to eject a black ink which is anionic (carrying a positive charge) and another print head may be utilized to eject a color ink which is cationic (carrying a negative charge), whereupon the inks react with the printing medium and/or each other so that they are quickly fixed on the printing medium. In this manner, reaction inks can be used to prevent bleeding between black and color inks on the printing medium, and thereby achieve a desired resolution color image.

Typically, several ink discharge nozzles are located in the discharge surface of the print head for ejecting ink from the print head onto the printing medium. It can be appreciated that the discharge surface and the discharge nozzles can become contaminated with residuary ink that does not reach the printing medium. For example, during ejection of ink from the discharge nozzles, a fine mist of ink particles may exist in the ink jet printing device which may then adhere to the discharge surface of the print head.

In addition, paper powder, dust and other contaminants may inadvertently adhere to the discharge surface of the print head. Such contaminants can impair the ability of the discharge nozzles to properly eject ink onto the recording medium, and can thereby impair the quality of a recorded image on the printing medium and the overall efficiency of the ink jet printing device. This is particularly a problem when two different types of ink are ejected from two different sets of discharge nozzles, either in one print head, or in separate print heads. In such a device, cross-contamination of the different types of ink can occur on the respective discharge surfaces of the different sets of discharge nozzles. For example, black ink ejected from a black ink print head might inadvertently adhere to the discharge surface of a color ink print head during printing, thereby blocking the discharge nozzles of the color print head. In addition, inks of different types often react to result in a hardening of the combination ink on the discharge surface or, in the case of reaction inks, to quickly and strongly fix to the discharge surface, thereby impairing the operation of the respective discharge nozzles of the discharge surface.

For these reasons, ink jet printing devices often have the capability to perform some type of recovery of the discharge surface of the print head to maintain a good printing quality from the print head. For example, conventional ink jet printing devices often have a recovery system for performing recovery operations on the print head. Such a recovery system is often located in the main scanning direction of the carriage, but outside the printing area of the recording medium. Conventional recovery systems often include at least one cap which is shaped to engage and seal the print head, thereby protecting the discharge surface of the print head during non-use. In addition, a suction device, such as a purge pump, is often connected to the cap in order to remove undesirable contaminants from the discharge surface and the discharge nozzles of the print head while the cap is engaged to the print head. Furthermore, a typical recovery system also includes a wiper blade for wiping contaminants and adherents from the discharge surface and discharge nozzles of the print head. Often, a combination of these recovery operations is utilized to recover a printing quality of the print head. For example, the carriage on which the print head is mounted is first moved to the area of the recovery system. Then, the cap is engaged to the print head and negative pressure is applied by the suction device to draw contaminants, such as a residuary ink, from the discharge nozzles and discharge surface of the print head.

Optionally, a prefire operation may also be conducted in which the print head is commanded to eject a predetermined amount of ink in order to clear the discharge nozzles prior to printing. Such a prefire operation may take place while the cap is engaged to the print head, or may take place without having the cap engaged. Then, the cap is disengaged from the print head, after which the wiper blade is utilized to wipe the discharge surface of the print head. In this manner, the aforementioned recovery operations are utilized in an attempt to maintain the printing quality of the print head in as good a condition as possible.

While the conventional recovery system is used to remove contaminants and residual ink from the discharge surface and discharge nozzles of the print head, such recovery systems cannot sufficiently maintain a good printing condition of the print head in many situations. For example, in a conventional ink jet printing device with a recovery system as described above, it is often assumed that the print head is always positioned at a predetermined height above the recovery system during recovery operations. This predetermined height is desired to accommodate the length of the wiper blade, thereby ensuring consistent wiping of the discharge surface of the print head, as well as safe and consistent application of pressure from the wiper blade to the print head during wiping. In addition, the assumption of a predetermined height above the recovery system also facilitates the use of a known capping position in which to position the cap for effective engagement of the print head without causing damage to the print head.

In many instances, however, the actual distance between the print head and the recovery system varies due to a factory adjustment to account for position variations caused by the mechanical tolerance of each part. For example, a guide shaft which is provided to guide movement of the carriage in the printing direction is adjusted to satisfy a predetermined position of the carriage. In addition, the height of the carriage may be adjusted to account for a thickness of the recording medium during printing, thereby affecting the height of the carriage above the recovery system during recovery operations. Accordingly, when such conditions cause the gap between the print head and the recovery system to be inconsistent from one recovery operation to the next, the result of the wiping and capping operations will also be inconsistent.

A conventional recovery system may also be insufficient to maintain the print head in a good printing condition in the case where different inks are used in the ink jet printing device. If two different print heads are used which utilize two different types of ink, or if one print head is used which contains two sets of discharge nozzles which eject two different types of ink, problems can arise caused by cross-contamination of the two different types of ink on respective discharge surfaces. For example, when two different types of ink are utilized, such as dye and pigment inks, or reaction inks, it is preferable to use two separate caps wherein each cap is dedicated for capping of the set of discharge nozzles of each particular type of ink. In this manner, cross-contamination of ink on each cap is reduced during capping, thereby reducing subsequent cross-contamination from the cap to the respective discharge nozzles. However, during printing operation of the print head, each cap is left exposed and is therefore susceptible to cross-contamination by the adherence of ink which the cap is not intended to receive.

In addition, the caps are susceptible to contamination and damage from other sources, such as paper powder, dust and/or from improper handling by the user of the ink jet printing device. As discussed above, cross-contamination of the inks can cause the ink to fix on the cap, thereby reducing the ability of the cap to sufficiently form a seal on the print head. In addition, cross-contaminated ink residing on the cap can be transferred to the discharge surface of that cap's respective print head during capping operations, thereby contaminating the print head and impairing the printing condition of the discharge orifices of the print head.

The use of two different types of ink can also cause contamination of the wiper blade. Residuary ink particles are inadvertently distributed within the ink jet printing device during a printing operation and can adhere to the wiper blade while the wiper blade is not being used, thereby creating a cross-contamination of inks on the wiper blade. Such cross-contamination can reduce the effectiveness of the wiper blade during wiping of the discharge surface of the print head. In addition, a wiper blade which is cross-contaminated with two different kinds of ink can cause damage to a print head by contaminating the discharge surface of the print head with a different type of ink during a wiping operation. The wiper blade is also susceptible to other damage and contamination while the wiper blade is left exposed to the environment when not being used. The exposed wiper blade is therefore susceptible to other contaminants such as dust and paper powder, and is susceptible to damage from improper handling by the user of the ink jet recording device.

In addition to the above problems, the typical recovery system is often insufficient to remove residuary ink which is adhered to and dried on the discharge surface and discharge orifices of the print head. One possible solution is to perform a prefire operation to eject a limited amount of ink from the print head in an attempt to dissolve some of the dried residuary ink prior to wiping of the print head. However, if the prefire operation is performed near the recovery system, it may contaminate the cap, wiper and other parts with ink. It is also preferable to perform such a prefire operation away from the recording medium so as not to cause unwanted artifacts on the recorded image. One possible solution to such problems is to perform the prefiring at a location distant from the recovery system. In such a case, the time required to move the print head after prefiring to the location of the wiping blade for wiping can result in drying of the prefire ink prior to wiping, thereby reducing the effectiveness of the prefire operation.

In addition, if a separate prefire area is set aside in the scan direction of the carriage which is also outside the area of the recording medium and away from the recovery system, the size of the ink jet printing device is accordingly increased to accommodate the prefire area. Also, separate prefire areas are desired to receive the different types of ink when two different types of ink are used in a single print head, or in two separate print heads. Otherwise, cross-contamination of inks may occur within the ink jet printing device during prefiring which may impair the performance of parts affected by the contaminated ink.

A problem also occurs in conventional ink jet printing devices during capping of the print head when the cap is applied too quickly or forcefully to the print head. For example, if the cap is raised too quickly during the capping operation to engage the print head, or is applied to the print head with too much pressure, the cap can damage the discharge surface and discharge orifices of the print head. In addition, the foregoing conditions can result in the creation of positive pressure between the cap and the print head during the capping operation, thereby forcing air through the discharge nozzles, resulting in damage to the print head and the ink supply system by introducing air and air bubbles through the discharge nozzles into the print head.

Lastly, the use of two different types of ink in an ink jet printing device can cause cross-contamination of the respective sets of discharge nozzles, whether on one print head or on two separate print heads, when using a single wiper blade to wipe all discharge nozzles. For example, the use of a single wiper blade to wipe two different sets of discharge nozzles, each of which discharges a different type of ink, can result in the mixing of the two different inks on the single wiper blade which can cause cross-contamination and damage to the discharge orifices during subsequent wipings. In addition, if a print head is used which has an uneven print head surface, a single flat wiper blade cannot effectively wipe the discharge surface of the print head because the edge of the wiper blade will become distorted by the uneven discharge surface of the print head. In such a situation, the wiper blade will skip over areas of the discharge surface and will therefore be ineffective to clean residuary ink from the discharge surface.

In light of the problems with conventional recovery systems as discussed above, there is a need for an improvement in recovering the printing quality of the print head to a good condition.

SUMMARY OF THE INVENTION

The present invention addresses the foregoing by providing improved recovery of a print head in an ink jet printing device which includes accurate positioning of the print head in relation to a recovery mechanism during recovery operations, protection of the caps and the wiper during non-use, concurrent prefiring and wiping operations, dampened print head capping, and improved wiping of the print head with a partitioned, multi-portion wiper blade.

According to one aspect, the invention relates to maintaining a good print condition of a printing device which performs recording on a recording medium, the printing device including a carriage slidably mounted on the printing device in a lateral direction to scan the recording medium, and movable in a vertical direction to a plurality of predetermined distances above the recording medium during printing, and a print head mounted on the carriage, the print head having a discharge surface with a discharge nozzle located therein for ejecting ink on the recording medium. The good print condition is maintained by moving the carriage in the lateral direction to a location adjacent to a recovery mechanism disposed in the printing device, raising a carriage lever connected to the recovery mechanism to engage the carriage with the carriage lever, moving the carriage in the vertical direction with the carriage lever to a predetermined position above the recovery mechanism, performing one of a recovery operation and a capping operation of the print head while the carriage is in the predetermined position, moving the carriage in the vertical direction with the carriage lever away from the predetermined position, and lowering the carriage lever to disengage the carriage from the carriage lever.

Preferably, a lock pin is provided on the carriage lever to prevent the carriage from moving in a lateral direction during recovery operations or during transportation of the printing device, and a carriage lever support is utilized to rotate the carriage lever to move the carriage. In addition, a limiting post is preferably used to prevent the carriage lever from moving the carriage higher than the predetermined position.

By virtue of the foregoing, the carriage and print head are held in place during recovery operations, such as wiping and capping, to provide more accurate recovery of the print condition of the print head while also reducing contamination and damage to the print head during such recovery operations.

According to another aspect, the invention relates to maintaining a good print condition of a printing device which performs recording on a recording medium, the printing device including a carriage slidably mounted on the printing device in a first lateral direction to scan the recording medium, a print head mounted on the carriage, the print head having a discharge surface with a first set of discharge nozzles and a second set of discharge nozzles located therein, each set of discharge nozzles for ejecting a different type of ink on the recording medium. The good print condition is maintained by moving a wiper base in a recovery mechanism to a cover position in which the wiper base covers a first cap and a second cap provided in the recovery mechanism, the wiper base having a wiper blade mounted thereon, the wiper blade being covered by a wiper blade cover when the wiper base is at the cover position, ejecting ink from the first and second sets of discharge nozzles while scanning the print head in the first lateral direction to record an image on the recording medium, moving the print head to a position adjacent to the recovery mechanism, and moving the wiper base away from the cover position to uncover the first and second caps and the wiper blade for performing one of a capping operation and a wiping operation of the print head.

Preferably, the wiper base has a top surface to protect the caps and wiper blade from ink contamination during printing by the print head. The top surface preferably includes a first and a second prefire area disposed to receive ink from the first and second sets of discharge nozzles during prefire operations. The wiper blade is preferably mounted on the wiper base in a direction that runs across both of the first and a second prefire areas.

By virtue of the foregoing, the caps and the wiper blade are protected from ink contamination during printing, thereby reducing contamination to the print head during subsequent capping and wiping operations of the print head. Also, the location of the prefire areas near the wiper blade allows a prefire operation and a wiping operation to be performed concurrently for more effective cleaning of the print head, with reduction in contamination of other parts, such as the caps.

In a further aspect, the invention relates to maintaining a good print condition of a printing device which performs recording on a recording medium, the printing device including a carriage slidably mounted on the printing device in a lateral direction to scan the recording medium, and a print head mounted on the carriage, the print head having a discharge surface with a discharge nozzle located therein for ejecting ink on the recording medium. The good print condition is maintained by moving the carriage in the lateral direction to a position adjacent to a recovery mechanism, and rotating a cap lever support of a capping mechanism disposed in the recovery mechanism, the cap lever support having a first end and a second end, the first end being pivotally attached to the recovery mechanism and the second end being connected to a second end of a cap lever which supports a cap for capping the print head, the cap lever having a first end which is pivotally attached to the recovery mechanism, the capping mechanism further including a cap lever spring disposed between the cap lever and the cap lever support. The rotation of the cap lever support causes rotation of the cap lever to raise the cap for engaging and capping the print head, during which a force of the cap against the print head is dampened by the cap lever spring.

Preferably, the cap is made of rubber and is mounted in a cap holder on a cap base which is supported directly by the cap lever. The cap lever support is preferably rotated by a cap cam which is driven by a motor. A cap lever return spring is preferably connected to the cap lever support to bias the cap lever to a position which is out of the way of the scan path of the carriage when the caps are not in use.

By virtue of the foregoing, the caps are raised to the print head during a capping operation and are engaged with the print head with a reduced force so as to reduce damage to the print head, and the print head ink supply, during capping.

According to another aspect, the invention relates to maintaining a good print condition of a printing device which performs recording on a recording medium, the printing device including a carriage slidably mounted on the printing device in a lateral direction to scan the recording medium, and a print head mounted on the carriage, the print head having an uneven discharge surface comprised of a plurality of discharge surface portions, a first set of discharge nozzles disposed in one of the discharge surface portions, and a second set of discharge nozzles disposed in another of the discharge surface portions, each of the discharge nozzles for ejecting ink on the recording medium. The good print condition is maintained by moving the carriage in the lateral direction to a first wiping position adjacent to a wiper blade, the wiper blade being partitioned by a plurality of slits into a plurality of blade portions, and wiping with the discharge surface of the print head with the wiper blade, wherein each blade portion of the wiper blade wipes a respective discharge surface portion of the discharge surface.

Preferably, the discharge surface is wiped while the carriage is in a first wiping position, and is then wiped again after the carriage is moved to a second wiping position, thereby wiping unwiped portions of the discharge surface which corresponded to the wiper blade slits when the carriage was in the first wiping position. In addition, the execution time for wiping in the first wiping position is different than the execution time for wiping in the second wiping position. A wiper blade cleaner is also preferably provided to clean the wiper blade, wherein the wiper blade cleaner has a plurality of cleaning surface sections to accommodate the plurality of blade portions.

By virtue of the foregoing, a wiper blade is utilized to effectively wipe an uneven print head discharge surface, and to reduce cross-contamination of inks on the wiper blade between the blade portions that clean different discharge surface portions which eject different types of ink. The wiper blade has a corresponding wiper blade cleaner to effectively clean the different wiper blade portions without creating cross-contamination of ink on the wiper blade. In this manner, subsequent cross-contamination and damage to the discharge surface of the print head during wiping is reduced, and the discharge surface is wiped more efficiently.

According to yet another aspect, the invention relates to maintaining a good print condition of a printing device which performs recording on a recording medium, the printing device including a carriage slidably mounted on the printing device in a lateral direction to scan the recording medium, and a print head mounted on the carriage, the print head having an uneven discharge surface comprised of a plurality of discharge surface portions, a first set of discharge nozzles disposed in one of the discharge surface portions, and a second set of discharge nozzles disposed in another of the discharge surface portions, each of the discharge nozzles for ejecting ink on the recording medium. The good print condition is maintained by moving a wiper base in a recovery mechanism to a cover position in which the wiper base covers a first cap and a second cap provided in the recovery mechanism, the wiper base having a wiper blade mounted thereon, the wiper blade being covered by a wiper blade cover when the wiper base is at the cover position, thereby protecting the caps and the wiper blade during non-use, the wiper base further including a first prefire area and a second prefire area disposed on the wiper base for receiving ink ejected from the first and second sets of discharge nozzles, respectively, during a prefire recovery operation.

The good print condition is further maintained by moving the carriage in the lateral direction to a position adjacent to the recovery mechanism, raising a carriage lever connected to the recovery mechanism to engage the carriage with the carriage lever, moving the carriage in the vertical direction with the carriage lever to a predetermined position above the recovery mechanism, performing a prefire operation and a wiping operation of the print head while the carriage is in the predetermined position, the first and second prefire areas receiving the ink ejected from the first and second sets of discharge nozzles during the prefire operation, and the wiping operation performed with the wiper blade which is partitioned by a plurality of slits into a plurality of blade portions, each blade portion for wiping a respective discharge surface portion of the discharge surface. Also included is the feature of moving the wiper base away from the cover position to uncover the first and second caps, and rotating a cap lever support of a capping mechanism disposed in the recovery mechanism, the cap lever support having a first end and a second end, the first end being pivotally attached to the recovery mechanism and the second end being connected to a second end of a cap lever which supports the first and second caps for capping the print head, the cap lever having a first end which is pivotally attached to the recovery mechanism, the capping mechanism further including a cap lever spring disposed between the cap lever and the cap lever support, thereby raising the first and second caps to engage and cap the print head, during which a force of each cap against the print head is dampened by the cap lever spring.

The maintenance of the good print condition further includes applying a suction force to the discharge surface of the print head while the cap is engaged to the print head, rotating the cap lever support to lower the first and second caps from the print head, moving the carriage in the vertical direction with the carriage lever away from the predetermined position, and lowering the carriage lever to disengage the carriage from the carriage lever.

Preferably, a lock pin is provided on the carriage lever to prevent the carriage from moving in the lateral direction during recovery operations or transportation of the printing device, and a carriage lever support is utilized to rotate the carriage lever to move the carriage. The wiper base preferably has a top surface to protect the caps and wiper blade from ink contamination during printing by the print head, the top surface including a first and a second prefire area disposed to receive ink from the first and second sets of discharge nozzles during prefire operations. Preferably, the cap is made of rubber and is mounted in a cap holder on a cap base which is supported directly by the cap lever. The discharge surface is preferably wiped while the carriage is in a first wiping position, and is then wiped again after the carriage is moved to a second wiping position, thereby wiping unwiped portions of the discharge surface which corresponded to the wiper blade slits when the carriage was in the first wiping position. The second wiping position is secondary in comparison to the first wiping position which serves the main purpose of wiping the discharge surface.

Accordingly, wiping in the second wiping position may not be performed as often as wiping in the first wiping position. Even though the second wiping position may not be utilized as often as the first wiping position, the use of the second wiping position is effective to wipe unwiped portions of the discharge surface. Preferably, the execution time for wiping in the first wiping position is different than the execution time for wiping in the second wiping position. A wiper blade cleaner is also preferably provided to clean the wiper blade, wherein the wiper blade cleaner has a plurality of cleaning surface sections to accommodate the plurality of blade portions.

By virtue of the foregoing, the carriage and print head are held in place during recovery operations, such as wiping and capping, to provide more accurate recovery of the print condition of the print head while also reducing contamination and damage to the print head. Also, the caps and the wiper blade are protected from ink contamination during printing, and the location of the prefire areas near the wiper blade allows for concurrent prefire and wiping operations, with reduced contamination of other parts, such as the caps. In addition, the caps are raised and engaged to the print head with a reduced force so as to reduce damage to the print head, and the ink supply, during capping. Also, an improved wiper blade is used to effectively wipe an uneven print head discharge surface, and to reduce cross-contamination of inks on the wiper blade between the blade portions that clean discharge nozzles ejecting different types of ink. The corresponding wiper blade cleaner effectively cleans the different wiper blade portions without creating cross-contamination of ink on the wiper blade. Accordingly, an improved recovery of the print condition of the print head is achieved.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

FIG. 16*a* is a perspective view for explaining the adjustment of the carriage vertical position according to one embodiment of the present invention.

FIG. 16*b* is a side view for explaining the adjustment of the carriage vertical position according to one embodiment of the present invention.

DETAILED DESCRIPTION OF THE PREFERRED EMBODIMENTS

Figure 1:
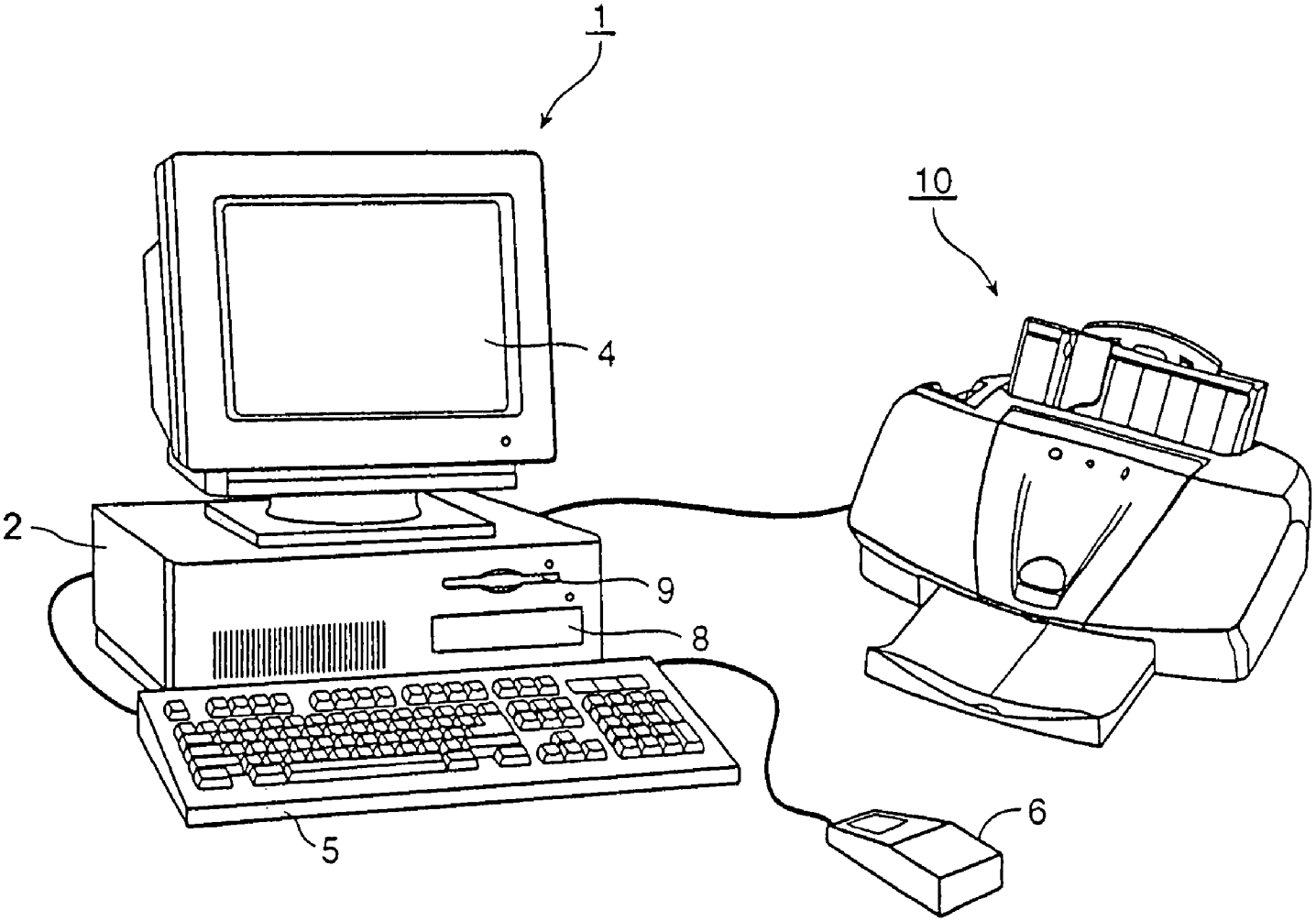
FIG. 1 shows a perspective view of computing equipment used in connection with the printer of the present invention.

FIG. 1 is a view showing the outward appearance of computing equipment used in connection with the invention described herein. Computing equipment 1 includes host processor 2. Host processor 2 comprises a personal computer (hereinafter "PC"), preferably an IBM PC-compatible computer having a windowing environment, such as Microsoft® Windows95. Provided with computing equipment 1 are display 4 comprising a color monitor or the like, keyboard 5 for entering text data and user commands, and pointing device 6. Pointing device 6 preferably comprises a mouse for pointing and for manipulating objects displayed on display 4.

Computing equipment 1 includes a computer-readable memory medium, such as fixed computer disk 8, and floppy disk interface 9. Floppy disk interface 9 provides a means whereby computing equipment 1 can access information, such as data, application programs, etc., stored on floppy disks. A similar CD-ROM interface (not shown) may be provided with computing equipment 1, through which computing equipment 1 can access information stored on CD-ROMs.

Disk 8 stores, among other things, application programs by which host processor 2 generates files, manipulates and stores those files on disk 8, presents data in those files to an operator via display 4, and prints data in those files via printer 10. Disk 8 also stores an operating system which, as noted above, is preferably a windowing operating system such as Windows95. Device drivers are also stored in disk 8. At least one of the device drivers comprises a printer driver which provides a software interface to firmware in printer 10. Data exchange between host processor 2 and printer 10 is described in more detail below.

Figure 2:
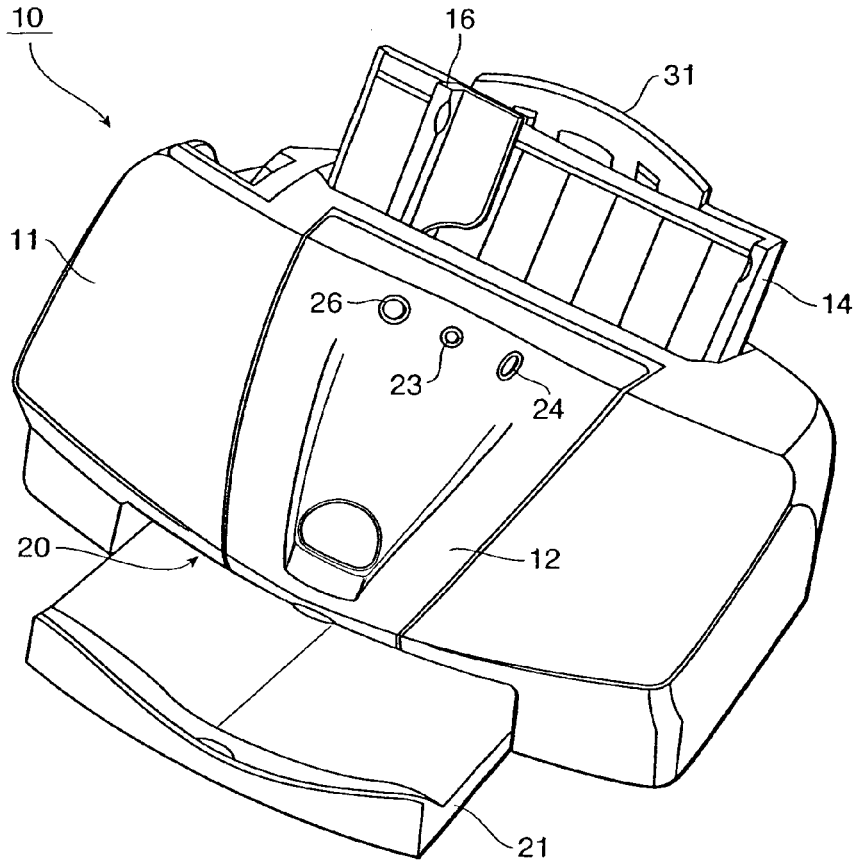
FIG. 2 is a front perspective view of the printer shown in FIG. 1.
Figure 3:
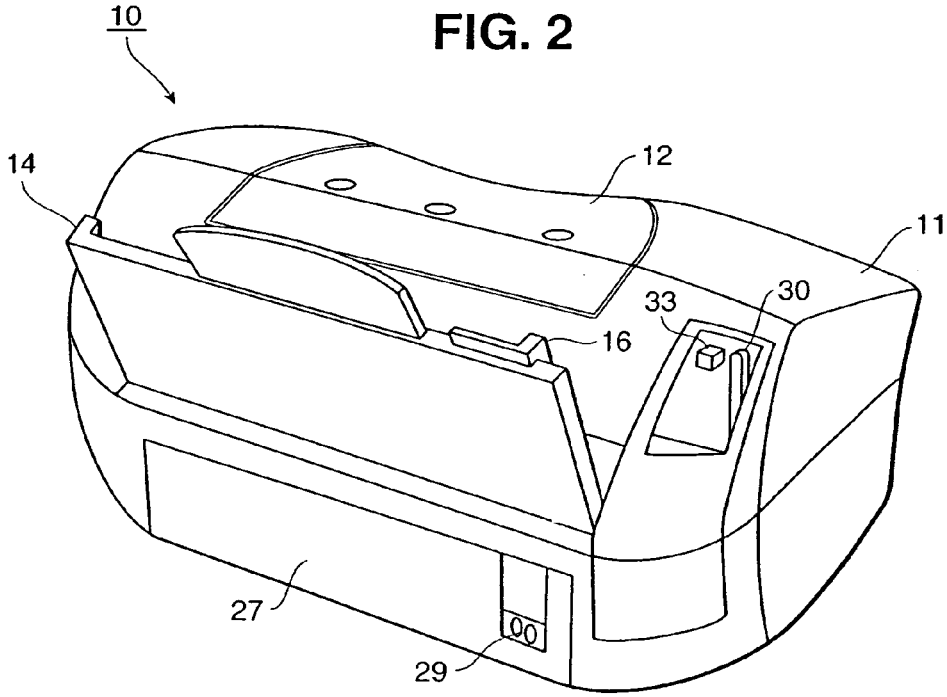
FIG. 3 is a back perspective view of the printer shown in FIG. 1.

FIGS. 2 and 3 show perspective front and back views, respectively, of printer 10. As shown in FIGS. 2 and 3, printer 10 includes housing 11, access door 12, automatic feeder 14, automatic feed adjuster 16, media eject port 20, ejection tray 21, power source 27, power cord connector 29, parallel port connector 30 and universal serial bus (USB) connector 33.

Housing 11 houses the internal workings of printer 10, including a print engine which controls the printing operations to print images onto recording media. Included on housing 11 is access door 12. Access door 12 is manually openable and closeable so as to permit a user to access the internal workings of printer 10 and, in particular, to access ink tanks installed in printer 10 so as to allow the user to change or replace the ink tanks as needed. Access door 12 also includes indicator light 23, power on/off button 26 and resume button 24. Indicator light 23 may be an LED that lights up to provide an indication of the status of the printer, i.e. powered on, a print operation in process (blinking), or a failure indication. Power on/off button 26 may be utilized to turn the printer on and off and resume button 24 may be utilized to reset an operation of the printer.

As shown in FIGS. 2 and 3, automatic feeder 14 is also included on housing 11 of printer 10. Automatic feeder 14 defines a media feed portion of printer 10. That is, automatic feeder 14 stores recording media onto which printer 10 prints images. In this regard, printer 10 is able to print images on a variety of types of recording media. These types include, but are not limited to, plain paper, high resolution paper, transparencies, glossy paper, glossy film, back print film, fabric sheets, T-shirt transfers, bubble jet paper, greeting cards, brochure paper, banner paper, thick paper, etc.

During printing, individual sheets which are stacked within automatic feeder 14 are fed from automatic feeder 14 through printer 10. Automatic feeder 14 includes automatic feed adjuster 16. Automatic feed adjuster 16 is laterally movable to accommodate different media sizes within automatic feeder 14. These sizes include, but are not limited to, letter, legal, A4, B5 and envelope. Custom-sized recording media can also be used with printer 10. Automatic feeder 14 also includes backing 31, which is extendible to support recording media held in automatic feeder 14. When not in use, backing 31 is stored within a slot in automatic feeder 14, as shown in FIG. 2.

As noted above, media are fed through printer 10 and ejected from eject port 20 into ejection tray 21. Ejection tray 21 extends outwardly from housing 11 as shown in FIG. 2 and provides a receptacle for the recording media upon ejection for printer 10. When not in use, ejection tray 21 may be stored within printer 10.

Power cord connector 29 is utilized to connect printer 10 to an external AC power source. Power supply 27 is used to convert AC power from the external power source, and to supply the converted power to printer 10. Parallel port 30 connects printer 10 to host processor 2. Parallel port 30 preferably comprises an IEEE-1284 bi-directional port, over which data and commands are transmitted between printer 10 and host processor 2. Alternatively, data and commands can be transmitted to printer 10 through USB port 33.

Figure 4:
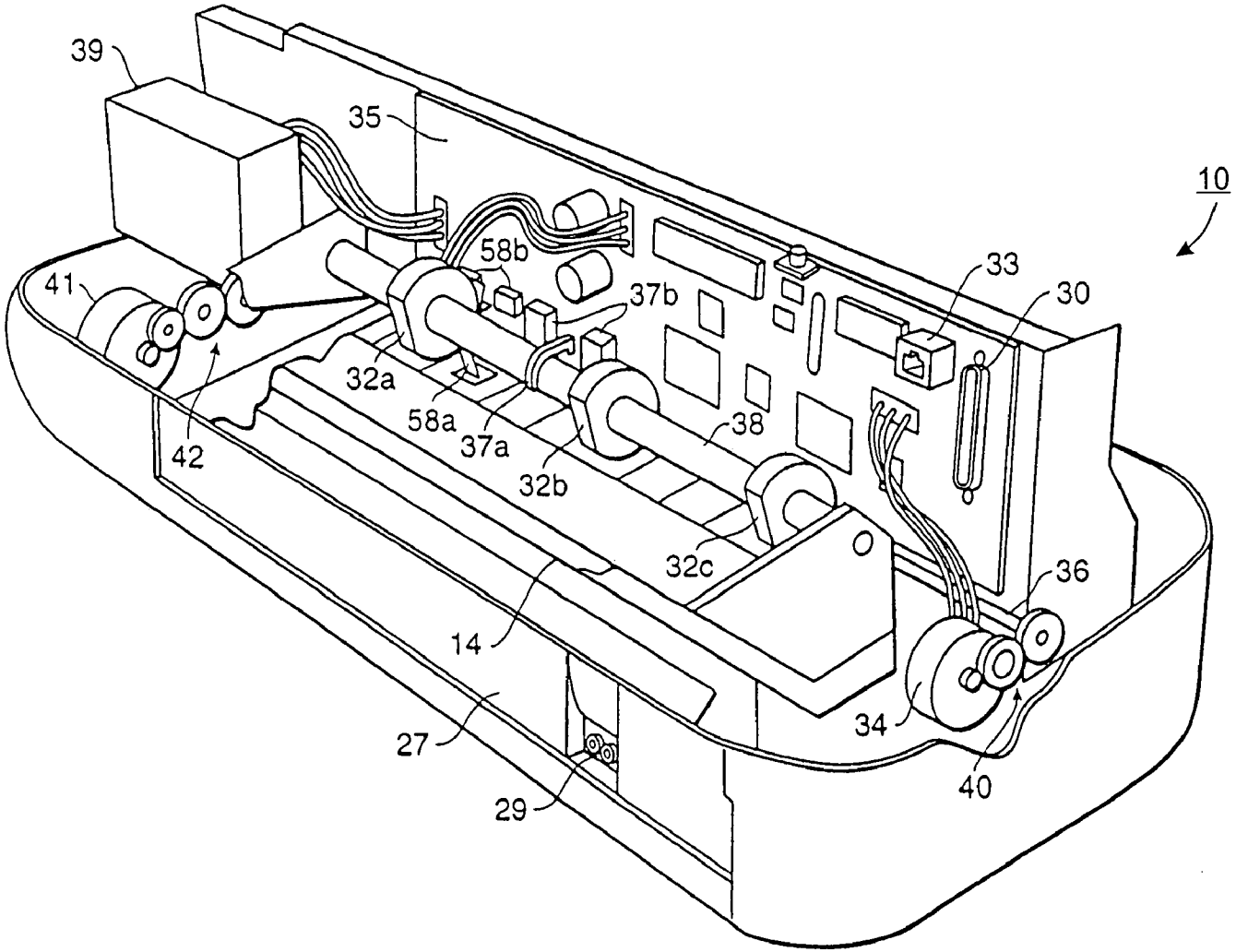
FIG. 4 is a back, cutaway perspective view of the printer shown in FIG. 1.
Figure 5:
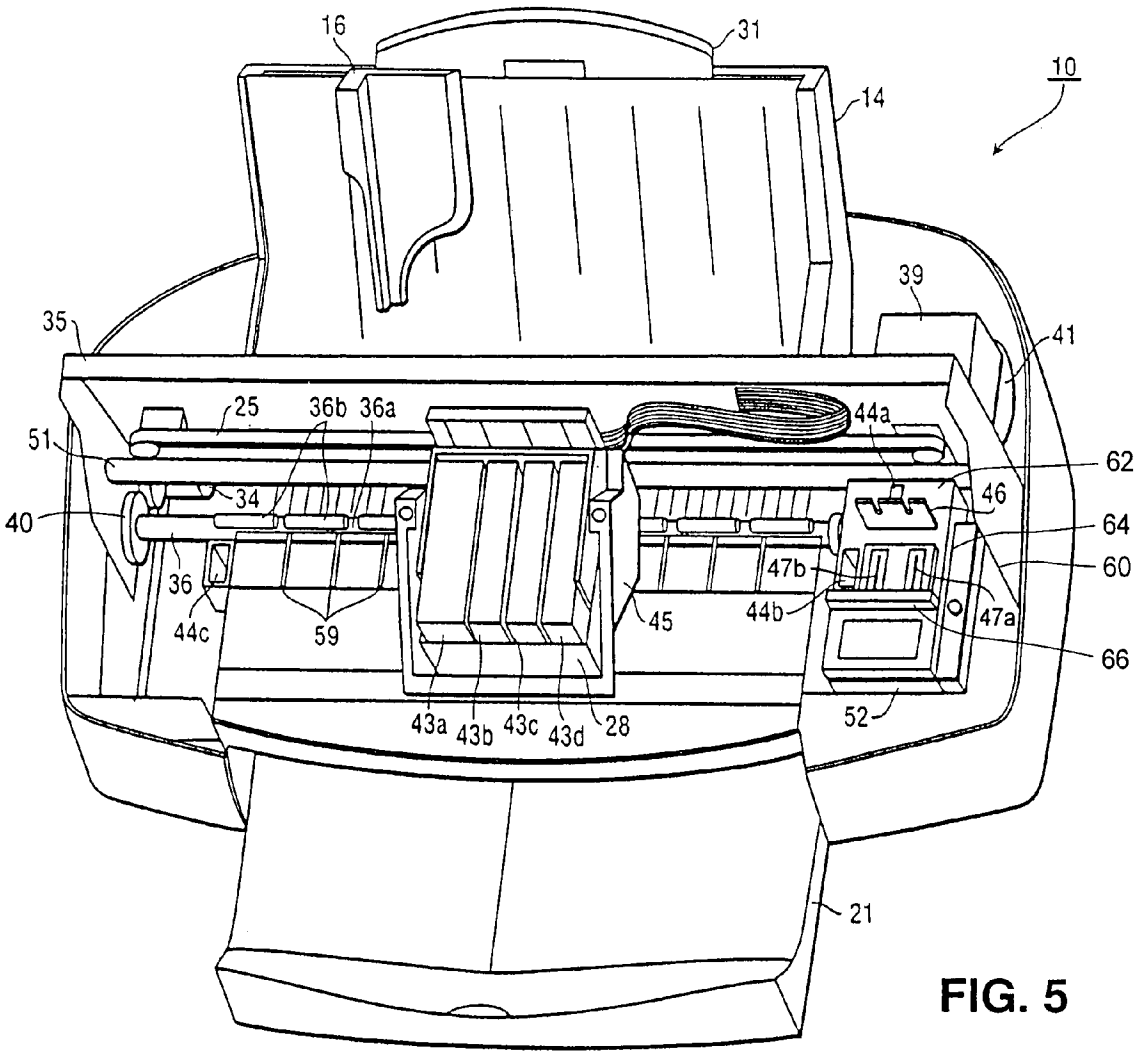
FIG. 5 is a front, cutaway perspective view of the printer shown in FIG. 1.

FIGS. 4 and 5 show back and front cutaway perspective views, respectively, of printer 10. As shown in FIG. 4, printer 10 includes an automatic sheet feed assembly (ASF) that comprises automatic sheet feeder 14, ASF rollers 32*a*, 32*b* and 32*c* attached to ASF shaft 38 for feeding media from automatic feeder 14. ASF shaft 38 is driven by drive train assembly 42. Drive train assembly 42 is made up of a series of gears that are connected to and driven by ASF motor 41. Drive train assembly 42 is described in more detail below with reference to FIGS. 6A and 6B. ASF motor 41 is preferably a stepper motor that rotates in stepped increments (pulses). Utilization of a stepper motor provides the ability for a controller incorporated in circuit board 35 to count the number of steps the motor rotates each time the ASF is actuated. As such, the position of the ASF rollers at any instant can be determined by the controller. ASF shaft 38 also includes an ASF initialization sensor tab 37*a*. When the ASF shaft is positioned at a home position (initialization position), tab 37*a* is positioned between ASF initialization sensors 37*b*. Sensors 37*b* are light beam sensors such that when tab 37*a* is positioned between sensors 37*b*, tab 37*a* breaks continuity of the light beam, thereby indicating that the ASF is at the home position.

Also shown in FIG. 4 is a page edge (PE) detector lever 58*a* and PE sensors 58*b*. PE sensors 58*b* are similar to ASF initialization sensors 37*b*. That is, they are light beam sensors. PE lever 58*a* is pivotally mounted and is actuated by a sheet of the recording medium being fed through the printer 10. When no recording medium is being fed through printer 10, lever 58*a* is at a home position and breaks continuity of the light beam between sensors 58*b*. As a sheet of the recording medium is fed through the printer, first by the ASF rollers then by the line feed rollers (described below), the leading edge of the recording medium engages PE lever 58*a* pivotally moving the lever to allow continuity of the light beam to be established between sensors 58*b*. Lever 58*a* remains in this position while the recording medium is being fed through printer 10 until the trailing edge of the recording medium reaches PE lever 58*a*, thereby disengaging lever 58*a* from the recording medium and allowing lever 58*a* to return to its home position to break the light beam. The PE sensor is utilized in this manner to sense when a page of the recording medium is being fed through the printer and the sensors provide feedback of such to a controller on circuit board 35.

Figure 6A:
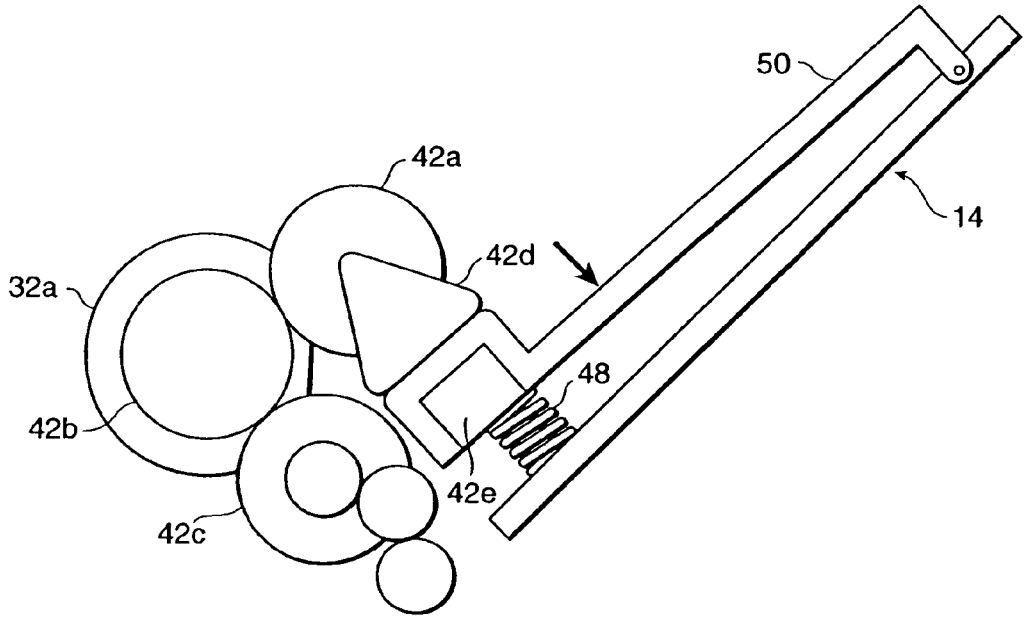
FIGS. 6A and 6B show a geartrain configuration for an automatic sheet feeder of the printer shown in FIG. 1.
Figure 6B:
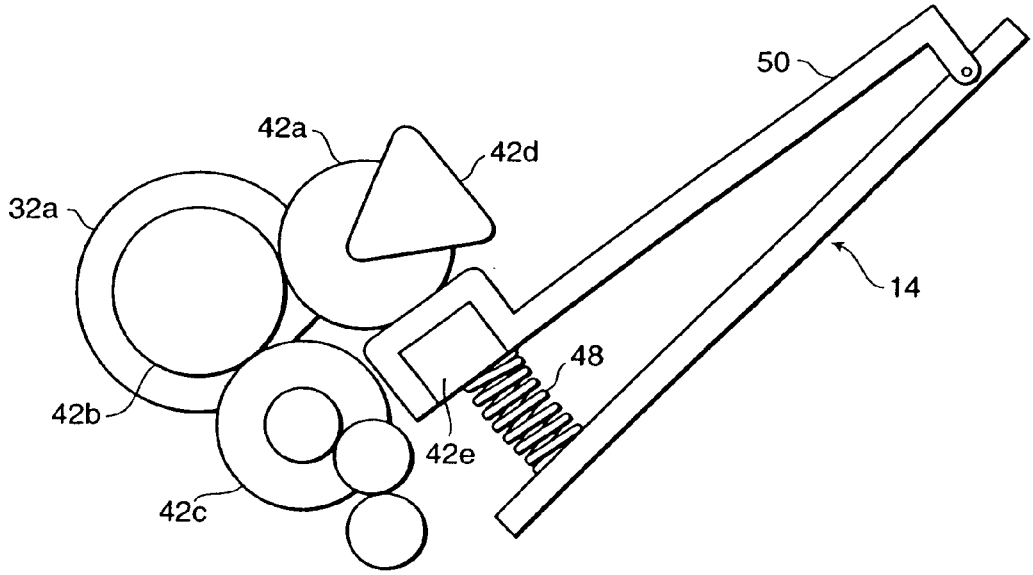

ASF gear train assembly 42 may appear as shown in FIGS. 6A and 6B. As shown in FIG. 6A, gear train assembly 42 comprises gears 42*a*, 42*b* and 42*c*. Gear 42*b* is attached to the end of ASF shaft 38 and turns the shaft when ASF motor 41 is engaged. Gear 42*a* engages gear 42*b* and includes a cam 42*d* that engages an ASF tray detent arm 42*e* of automatic feeder 14. As shown in FIG. 6A, when ASF shaft 38 is positioned at the home position, cam 42*d* presses against detent arm 42*e*. Automatic feeder 14 includes a pivotally mounted plate 50 that is biased by spring 48 so that when cam 42*d* engages detent arm 42*e*, automatic feeder 14 is depressed and when cam 42*d* disengages detent arm 42*e* (such as that shown in FIG. 6B), plate 50 is released. Depressing detent arm 42*e* causes the recording media stacked in automatic feeder 14 to move away from ASF rollers 32*a*, 32*b* and 32*c* and releasing detent arm 42*e* allows the recording to move close to the rollers so that the rollers can engage the recording medium when the ASF motor is engaged.

Returning to FIG. 4, printer 10 includes line feed motor 34 that is utilized for feeding the recording medium through printer 10 during printing operations. Line feed motor 34 drives line feed shaft 36, which includes line feed pinch rollers 36*a*, via line feed geartrain 40. The geartrain ratio for line feed geartrain 40 is set to advance the recording medium a set amount for each pulse of line feed motor 34. The ratio may be set so that one pulse of line feed motor 34 results in a line feed amount of the recording medium equal to a one pixel resolution advancement of the recording medium. That is, if one pixel resolution of the printout of printer 10 is 600 dpi (dots per inch), the geartrain ratio may be set so that one pulse of line feed motor 34 results in a 600 dpi advancement of the recording medium. Alternatively, the ratio may be set so that each pulse of the motor results in a line feed amount that is equal to a fractional portion of one pixel resolution rather than being a one-to-one ratio. Line feed motor 34 preferably comprises a 200-step, 2 phase pulse motor and is controlled in response to signal commands received from circuit board 35. Of course, line feed motor 34 is not limited to a 200-step 2 phase pulse motor and any other type of line feed motor could be employed, including a DC motor with an encoder.

As shown in FIG. 5, printer 10 is a single cartridge printer which prints images using dual print heads, one having nozzles for printing black ink and the other having nozzles for printing cyan, magenta and yellow inks. Specifically, carriage 45 holds cartridge 28 that preferably accommodates ink tanks 43*a*, 43*b*, 43*c* and 43*d*, each containing a different colored ink. A more detailed description of cartridge 28 and ink tanks 43*a* to 43*d* is provided below with regard to FIG. 7. Carriage 45 is driven by carriage motor 39 in response to signal commands received from circuit board 35. Specifically, carriage motor 39 controls the motion of belt 25, which in turn provides for horizontal translation of carriage 45 along carriage guide shaft 51. In this regard, carriage motor 39 provides for bi-directional motion of belt 25, and thus of carriage 45. By virtue of this feature, printer 10 is able to perform bi-directional printing, i.e. print images from both left to right and right to left.

Printer 10 preferably includes recording medium cockling ribs 59. Ribs 59 induce a desired cockling pattern into the recording medium which the printer can compensate for by adjusting the firing frequency of the print head nozzles. Ribs 59 are spaced a set distance apart, depending upon the desired cockling shape. The distance between ribs 59 may be based on motor pulses of carriage motor 39. That is, ribs 59 may be positioned according to how many motor pulses of carriage motor 39 it takes for the print head to reach the location. For example, ribs 59 may be spaced in 132 pulse increments.

Printer 10 also preferably includes recovery mechanism 60 located at the home position of the travel path of carriage 45 for performing recovery operations on the print heads of printer 10, thereby maintaining the print heads in a good printing condition. Recovery mechanism 60 includes pre-fire receptacle areas 44*a*, 44*b* and 44*c*, wiper blade 46, and print head caps 47*a* and 47*b*. Prefire receptacles 44*a* and 44*b* are located on recovery mechanism 60 at a home position of carriage 45 and receptacle 44*c* is located outside of a printable area and opposite the home position. At desired times during printing operations, a print head pre-fire operation may be performed to eject a small amount of ink from the print heads into receptacles 44*a*, 44*b* and/or 44*c*. Wiper blade 46 is actuated to move with a forward and backward motion relative to the printer. When carriage 45 is moved to its home position, wiper blade 46 is actuated to move forward and aft so as to traverse across each of the print heads of cartridge 28, thereby wiping excess ink from the print heads. Print head caps 47*a* and 47*b* are actuated in a relative up-and-down motion to engage and disengage the print heads when carriage 45 is at its home position. Wiper blade 46 and caps 47*a* and 47*b* are actuated by ASF motor 41 via a geartrain (not shown). Rotary pump 52 is also provided in recovery mechanism 60 and is connected to caps 47*a* and 47*b* via separate tubes (not shown). Pump 52 is connected to line feed shaft 36 via a geartrain (not shown) and is actuated by running line feed motor 34 in a reverse direction.

When caps 47*a* and 47*b* are actuated to engage the print heads, they form an airtight seal such that suction is applied by pump 52 through the tubes and caps 47*a* and 47*b* to suck ink from the print head nozzles through the tubes and into a waste ink container (not shown). Caps 47*a* and 47*b* also protect the nozzles of the print heads from dust, dirt and debris. Recovery mechanism 60 also includes wiper base 62, carriage lever 64 and wiper blade cover 66. Wiper base 62 holds prefire receptacle areas 44*a* and 44*b* and is used to cover caps 47*a* and 47*b* when they are not in use. Wiper blade cover 66 is used to cover wiper blade 46 when it is not being used and also to clean wiper blade 46. Carriage lever 64 is used to hold carriage 45 in the home position at a predetermined height above recovery mechanism 60 during recovery operations.

Figure 7:
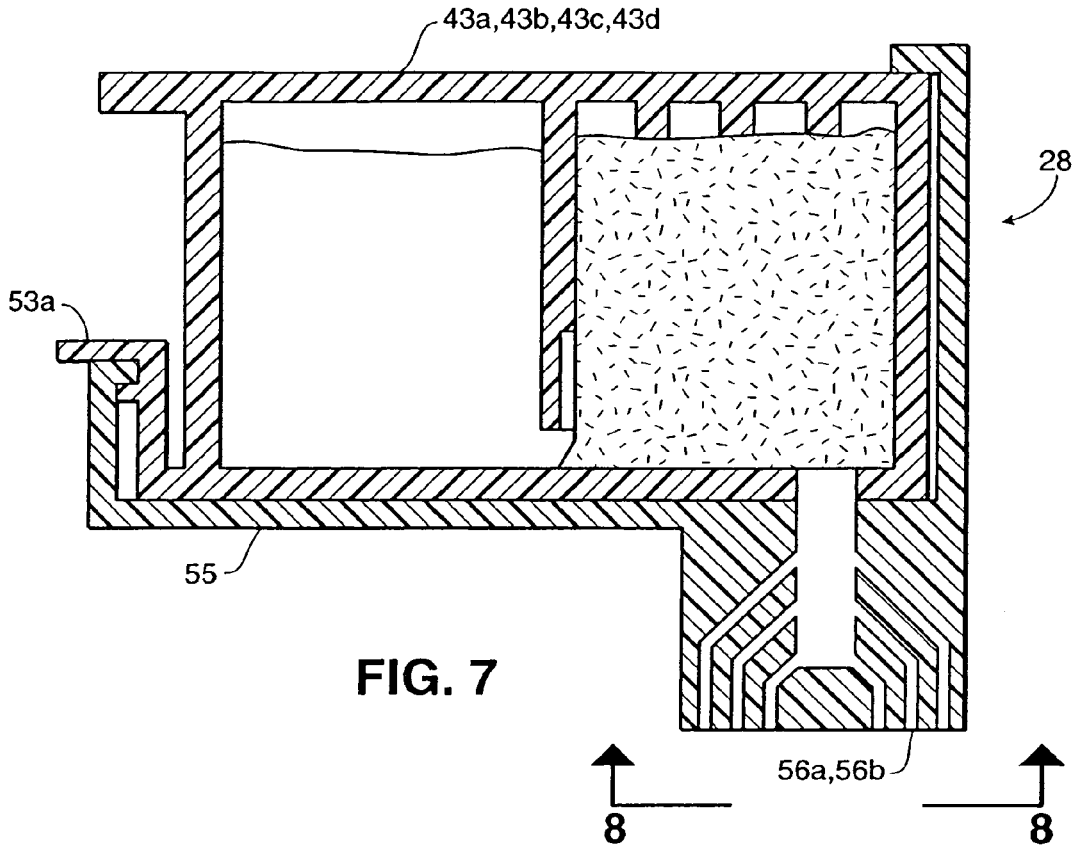
FIG. 7 is a cross-section view through a print cartridge and ink tank of the printer of FIG. 1.

FIG. 7 is a cross-sectional view through one of the ink tanks installed in cartridge 28. Ink cartridge 28 includes cartridge housing 55, print heads 56*a* and 56*b*, and ink tanks 43*a*, 43*b*, 43*c* and 43*d*. Cartridge body 28 accommodates ink tanks 43*a* to 43*d* and includes ink flow paths for feeding ink from each of the ink tanks to either of print heads 56*a* or 56*b*. Ink tanks 43*a* to 43*d* are removable from cartridge 28 and store ink used by printer 10 to print images. Specifically, ink tanks 43*a* to 43*d* are inserted within cartridge 28 and can be removed by actuating retention tabs 53*a* to 53*d*, respectively. Ink tanks 43*a* to 43*d* can store color (e.g., cyan, magenta and yellow) ink and/or black ink. The structure of ink tanks 43*a* to 43*b* may be similar to that described in U.S. Pat. No. 5,509,140, or may be any other type of ink tank that can be installed in cartridge 28 to supply ink to print heads 56*a* and 56*b*.

Figure 8:
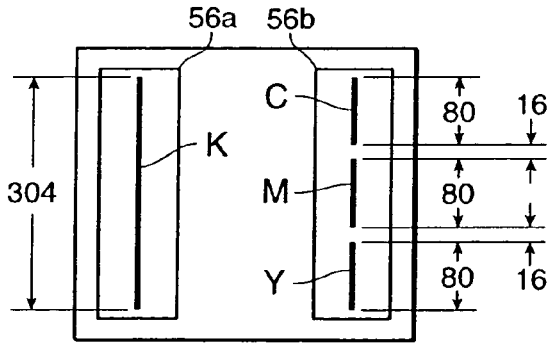
FIG. 8 is a plan view of a print head and nozzle configuration of the print cartridge of FIG. 7.

FIG. 8 depicts a nozzle configuration for each of print heads 56*a* and 56*b*. In FIG. 8, print head 56*a* is for printing black ink and print head 56*b* is for printing color ink. Print head 56*a* preferably includes 304 nozzles at a 600 dpi pitch spacing. Print head 56*b* preferably includes 80 nozzles at a 600 dpi pitch for printing cyan ink, 80 nozzles at a 600 dpi pitch for printing magenta ink, and 80 nozzles at a 600 dpi pitch for printing yellow ink. An empty space is provided between each set of nozzles in print head 56*b* corresponding to 16 nozzles spaced at a 600 dpi pitch. Each of print heads 56*a* and 56*b* eject ink based on commands received from a controller on circuit board 35.

Figure 9:
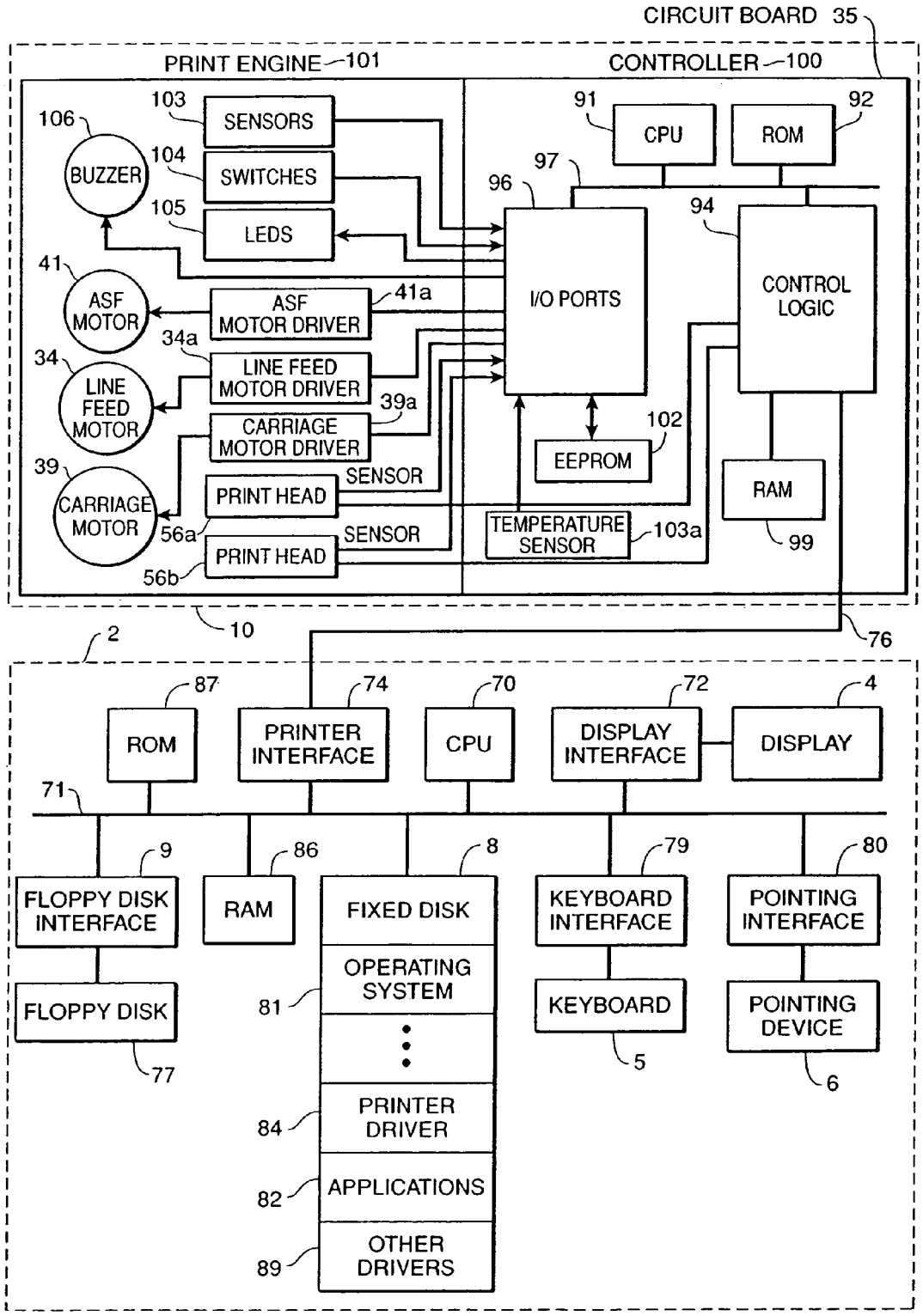
FIG. 9 is a block diagram showing the hardware configuration of a host processor interfaced to the printer of the present invention.

FIG. 9 is a block diagram showing the internal structures of host processor 2 and printer 10. In FIG. 9, host processor 2 includes a central processing unit 70 such as a programmable microprocessor interfaced to computer bus 71. Also coupled to computer bus 71 are display interface 72 for interfacing to display 4, printer interface 74 for interfacing to printer 10 through bi-directional communication line 76, floppy disk interface 9 for interfacing to floppy disk 77, keyboard interface 79 for interfacing to keyboard 5, and pointing device interface 80 for interfacing to pointing device 6. Disk 8 includes an operating system section for storing operating system 81, an applications section for storing applications 82, and a printer driver section for storing printer driver 84.

A random access main memory (hereinafter "RAM") 86 interfaces to computer bus 71 to provide CPU 70 with access to memory storage. In particular, when executing stored application program instruction sequences such as those associated with application programs stored in applications section 82 of disk 8, CPU 70 loads those application instruction sequences from disk 8 (or other storage media such as media accessed via a network or floppy disk interface 9) into random access memory (hereinafter "RAM") 86 and executes those stored program instruction sequences out of RAM 86. RAM 86 provides for a print data buffer used by printer driver 84. It should also be recognized that standard disk-swapping techniques available under the windowing operating system allow segments of memory, including the aforementioned print data buffer, to be swapped on and off of disk 8. Read only memory (hereinafter "ROM") 87 in host processor 2 stores invariant instruction sequences, such as start-up instruction sequences or basic input/output operating system (BIOS) sequences for operation of keyboard 5.

As shown in FIG. 9, and as previously mentioned, disk 8 stores program instruction sequences for a windowing operating system and for various application programs such as graphics application programs, drawing application programs, desktop publishing application programs, and the like. In addition, disk 8 also stores color image files such as might be displayed by display 4 or printed by printer 10 under control of a designated application program. Disk 8 also stores a color monitor driver in other drivers section 89 which controls how multi-level RGB color primary values are provided to display interface 72. Printer driver 84 controls printer 10 for both black and color printing and supplies print data for print out according to the configuration of printer 10. Print data is transferred to printer 10, and control signals are exchanged between host processor 2 and printer 10, through printer interface 74 connected to line 76 under control of printer driver 84. Printer interface 74 and line 76 may be, for example, an IEEE 1284 parallel port and cable or a universal serial bus port and cable. Other device drivers are also stored on disk 8, for providing appropriate signals to various devices, such as network devices, facsimile devices, and the like, connected to host processor 2.

Ordinarily, application programs and drivers stored on disk 8 first need to be installed by the user onto disk 8 from other computer-readable media on which those programs and drivers are initially stored. For example, it is customary for a user to purchase a floppy disk, or other computer-readable media such as CD-ROM, on which a copy of a printer driver is stored. The user would then install the printer driver onto disk 8 through well-known techniques by which the printer driver is copied onto disk 8. At the same time, it is also possible for the user, via a modem interface (not shown) or via a network (not shown), to download a printer driver, such as by downloading from a file server or from a computerized bulletin board.

Referring again to FIG. 9, printer 10 includes a circuit board 35 which essentially contain two sections, controller 100 and print engine 101. Controller 100 includes CPU 91 such as an 8-bit or a 16-bit microprocessor including programmable timer and interrupt controller, ROM 92, control logic 94, and I/O ports unit 96 connected to bus 97. Also connected to control logic 94 is RAM 99. Control logic 94 includes controllers for line feed motor 34, for print image buffer storage in RAM 99, for heat pulse generation, and for head data. Control logic 94 also provides control signals for nozzles in print heads 56*a* and 56*b* of print engine 101, carriage motor 39, ASF motor 41, line feed motor 34, and print data for print heads 56*a* and 56*b*. EEPROM 102 is connected to I/O ports unit 96 to provide non-volatile memory for printer information and also stores parameters that identify the printer, the driver, the print heads, the status of ink in the cartridges, etc., which are sent to printer driver 84 of host processor 2 to inform host processor 2 of the operational parameters of printer 10.

I/O ports unit 96 is coupled to print engine 101 in which a pair of print heads 56*a* and 56*b* perform recording on a recording medium by scanning across the recording medium while printing using print data from a print buffer in RAM 99. Control logic 94 is also coupled to printer interface 74 of host processor 2 via communication line 76 for exchange of control signals and to receive print data and print data addresses. ROM 92 stores font data, program instruction sequences used to control printer 10, and other invariant data for printer operation. RAM 99 stores print data in a print buffer defined by printer driver 84 for print heads 56*a* and 56*b* and other information for printer operation.

Sensors, generally indicated as 103, are arranged in print engine 101 to detect printer status and to measure temperature and other quantities that affect printing. A photo sensor (e.g., an automatic alignment sensor) measures print density and dot locations for automatic alignment. Sensors 103 are also arranged in print engine 101 to detect other conditions such as the open or closed status of access door 12, presence of recording media, etc. In addition, diode sensors, including a thermistor, are located in print heads 56*a* and 56*b* to measure print head temperature, which is transmitted to I/O ports unit 96.

I/O ports unit 96 also receives input from switches 104 such as power button 26 and resume button 24 and delivers control signals to LEDs 105 to light indicator light 23, to line feed motor 34 ASF motor 41 and carriage motor 39 through line feed motor driver 34*a*, ASF motor driver 41*a* and carriage motor driver 39*a*, respectively.

Although FIG. 9 shows individual components of printer 10 as separate and distinct from one another, it is preferable that some of the components be combined. For example, control logic 94 may be combined with I/O ports 96 in an ASIC to simplify interconnections for the functions of printer 10.

Figure 10:
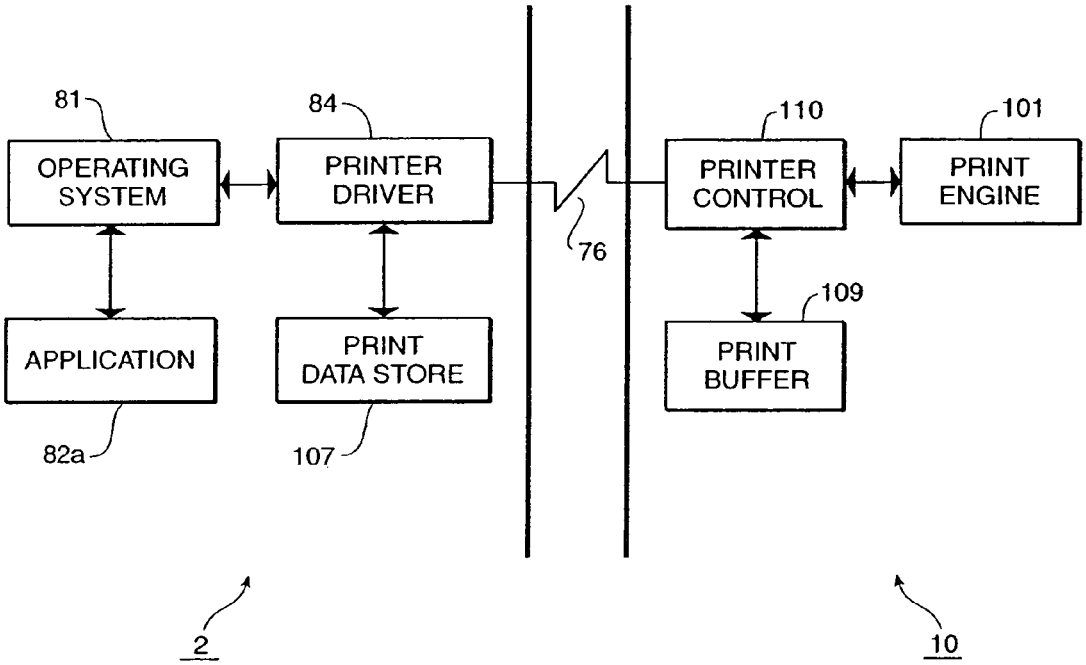
FIG. 10 shows a functional block diagram of the host processor and printer shown in FIG. 8.

FIG. 10 shows a high-level functional block diagram that illustrates the interaction between host processor 2 and printer 10. As illustrated in FIG. 10, when a print instruction is issued from image processing application program 82*a* stored in application section 82 of disk 8, operating system 81 issues graphics device interface calls to printer driver 84. Printer driver 84 responds by generating print data corresponding to the print instruction and stores the print data in print data store 107. Print data store 107 may reside in RAM 86 or in disk 8, or through disk swapping operations of operating system 81 may initially be stored in RAM 86 and swapped in and out of disk 8. Thereafter, printer driver 84 obtains print data from print data store 107 and transmits the print data through printer interface 74, to bi-directional communication line 76, and to print buffer 109 through printer control 110. Print buffer 109 resides in RAM 99, and printer control 110 resides in firmware implemented through control logic 94 and CPU 91 of FIG. 9. Printer control 110 processes the print data in print buffer 109 responsive to commands received from host processor 2 and performs printing tasks under control of instructions stored in ROM 92 (see FIG. 9) to provide appropriate print head and other control signals to print engine 101 for recording images onto recording media.

Print buffer 109 has a first section for storing print data to be printed by one of print heads 56*a* and 56*b*, and a second section for storing print data to be printed by the other one of print heads 56*a* and 56*b*. Each print buffer section has storage locations corresponding to the number of print positions of the associated print head. These storage locations are defined by printer driver 84 according to a resolution selected for printing. Each print buffer section also includes additional storage locations for transfer of print data during ramp-up of print heads 56*a* and 56*b* to printing speed. Print data is transferred from print data store 107 in host processor 2 to storage locations of print buffer 109 that are addressed by printer driver 84. As a result, print data for a next scan may be inserted into vacant storage locations in print buffer 109 both during ramp up and during printing of a current scan.

Figure 11:
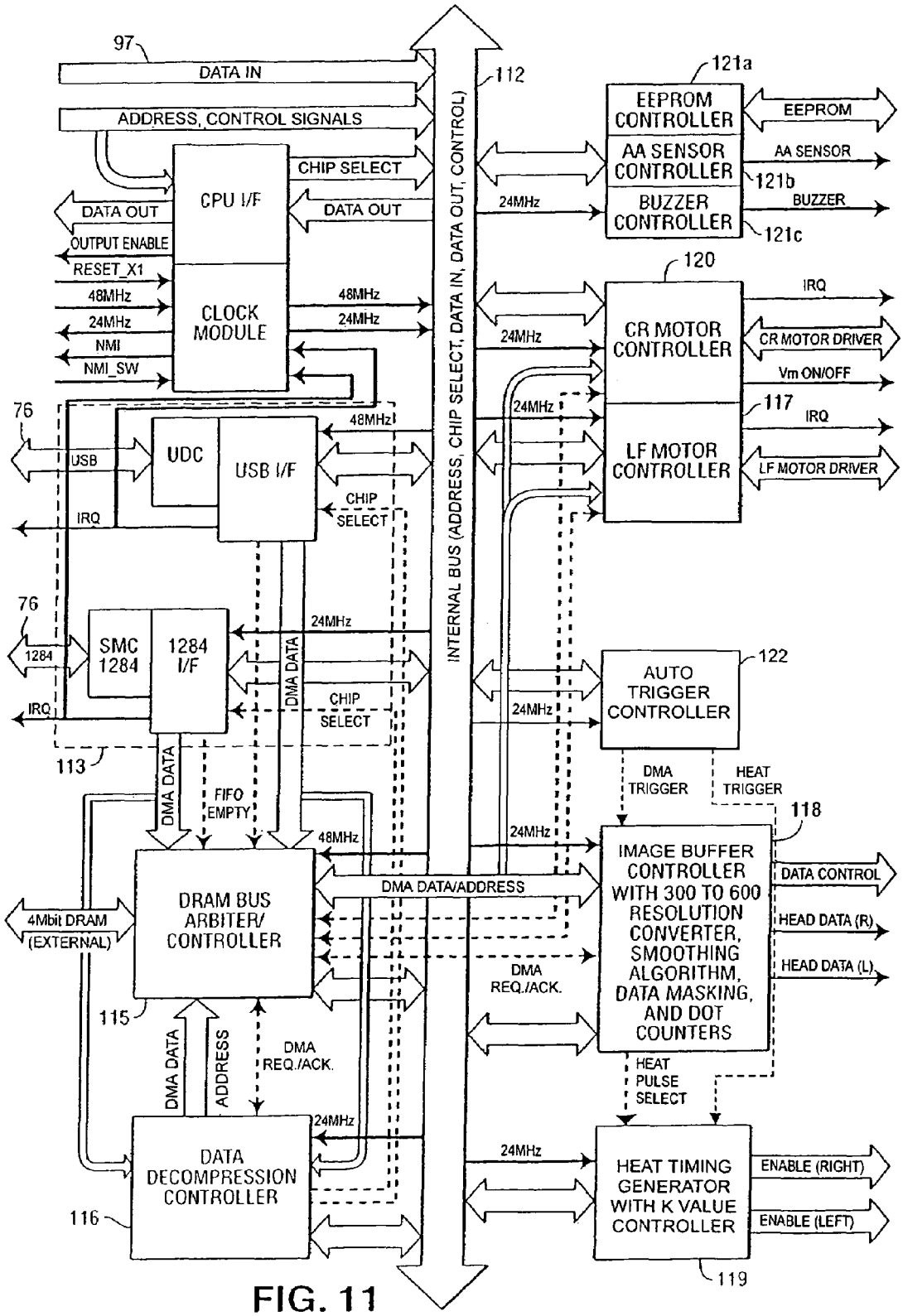
FIG. 11 is a block diagram showing the internal configuration of the gate array shown in FIG. 9.

FIG. 11 depicts a block diagram of a combined configuration for control logic 94 and I/O ports unit 96, which as mentioned above, I/O ports unit 96 may be included within control logic 94. In FIG. 11, internal bus 112 is connected to printer bus 97 for communication with printer CPU 91. Bus 112 is coupled to host computer interface 113 (shown in dashed lines) which is connected to bi-directional line 76 for carrying out bi-directional communication.

As shown in FIG. 11, bi-directional line 76 may be either an IEEE-1284 line or a USB line. Bi-directional communication line 76 is also coupled to printer interface 74 of host processor 2. Host computer interface 113 includes both IEEE-1284 and USB interfaces, both of which are connected to bus 112 and to DRAM bus arbiter/controller 115 for controlling RAM 99 which includes print buffer 109 (see FIGS. 9 and 10). Data decompressor 116 is connected to bus 112, DRAM bus arbiter/controller 115 and each of the IEEE-1284 and USB interfaces of host computer interface 113 to decompress print data when processing. Also coupled to bus 112 are line feed motor controller 117 that is connected to line feed motor driver 34*a* of FIG. 9, image buffer controller 118 which provides serial control signals and head data signals for each of print heads 56*a* and 56*b*, heat timing generator 119 which provides block control signals and analog heat pulses for each of print heads 56*a* and 56*b*, and carriage motor controller 120 that is connected to carriage motor driver 39*a* of FIG. 9.

Additionally, EEPROM controller 121*a*, automatic alignment sensor controller 121*b* and buzzer controller 121 are connected to bus 112 for controlling EEPROM 102, an automatic alignment sensor (generally represented within sensors 103 of FIG. 9), and buzzer 106. Further, auto trigger controller 122 is connected to bus 112 and provides signals to image buffer controller 118 and heat timing generator 119, for controlling the firing of the nozzles of print heads 56*a* and 56*b*.

Control logic 94 operates to receive commands from host processor 2 for use in CPU 91, and to send printer status and other response signals to host processor 2 through host computer interface 113 and bi-directional communication line 76. Print data and print buffer memory addresses for print data received from host processor 2 are sent to print buffer 109 in RAM 99 via DRAM bus arbiter/controller 115, and the addressed print data from print buffer 109 is transferred through controller 115 to print engine 101 for printing by print heads 56*a* and 56*b*. In this regard, heat timing generator 119 generates analog heat pulses required for printing the print data.

Figure 12:
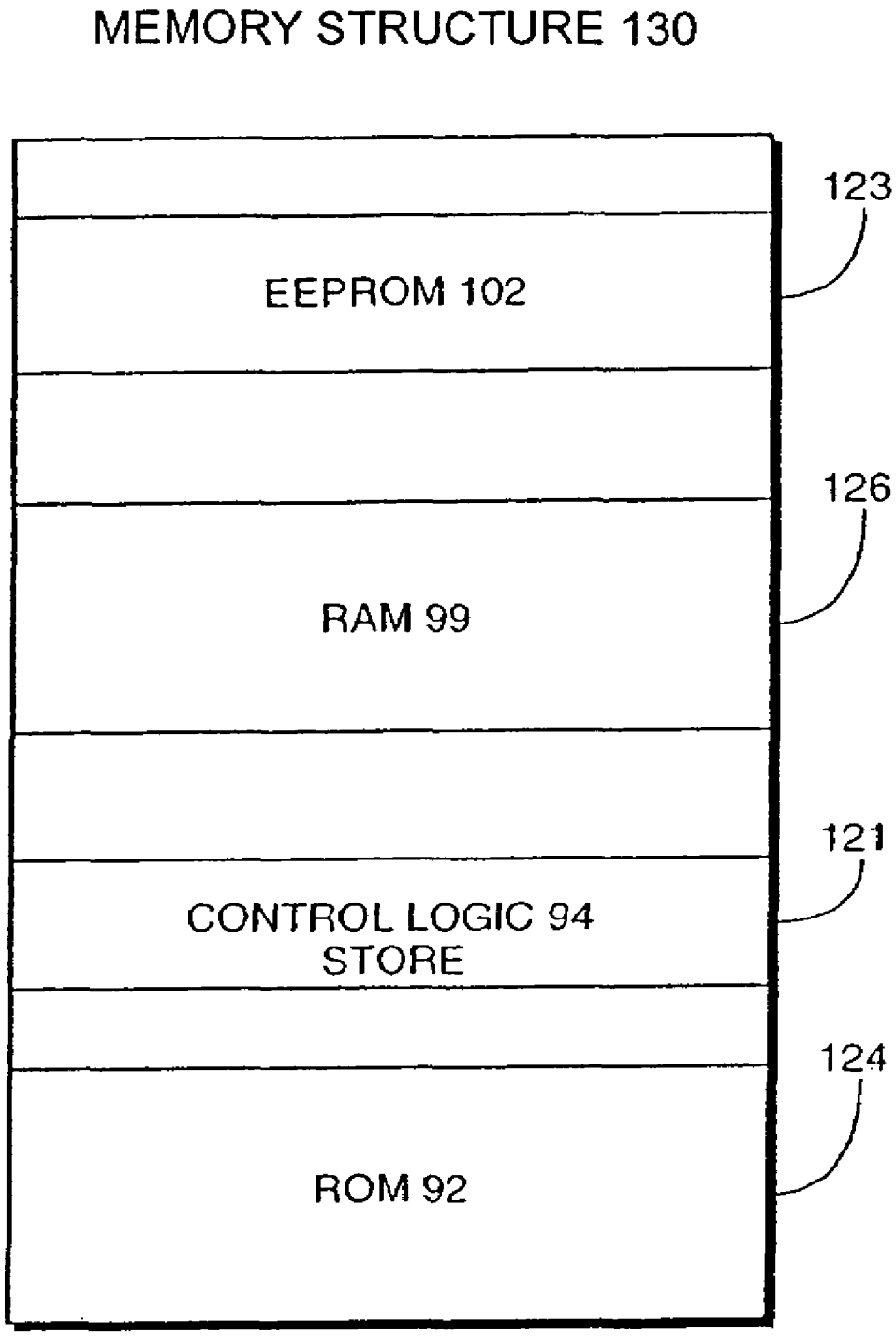
FIG. 12 shows the memory architecture of the printer of the present invention.

FIG. 12 shows the memory architecture for printer 10. As shown in FIG. 11, EEPROM 102, RAM 99, ROM 92 and temporary storage 121 for control logic 94 form memory structure 130 with a single addressing arrangement. Referring to FIG. 11, EEPROM 102, shown as non-volatile memory section 123, stores a set of parameters that are used by host processor 2 and that identify printer and print heads, print head status, print head alignment, and other print head characteristics. EEPROM 102 also stores another set of parameters, such as clean time, auto-alignment sensor data, etc., which are used by printer 10. ROM 92, shown as memory section 124, stores information for printer operation that is invariant, such as program sequences for printer tasks and print head operation temperature tables that are used to control the generation of nozzle heat pulses, etc. A random access memory section 121 stores temporary operational information for control logic 94, and memory section 126 corresponding to RAM 99 includes storage for variable operational data for printer tasks and print buffer 109.

Figure 13:
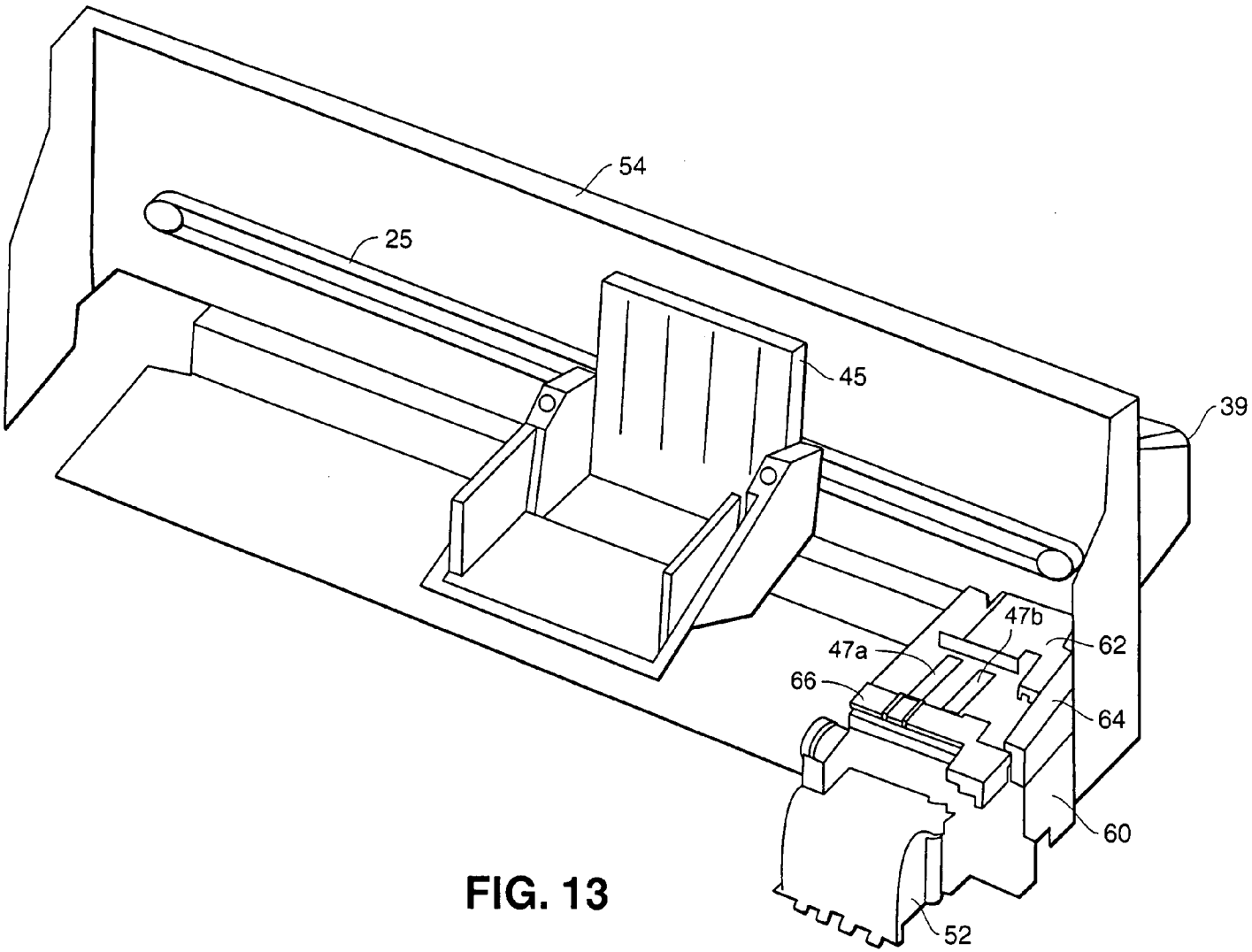
FIG. 13 is a perspective view for showing the recovery mechanism in the printer according to one embodiment of the present invention.

FIG. 13 is a perspective view for showing recovery mechanism 60 in printer 10. As seen in FIG. 13, carriage 45 travels in a lateral direction within chassis 54 of printer 10 along a guide shaft (not shown). Carriage 45 is driven by carriage belt 25 which is driven by carriage motor 39. Recovery mechanism 60 is located at a home position in the carriage travel path and includes components necessary to perform recovery operations on print heads 56*a* and 56*b* to maintain them in a good printing condition.

Recovery mechanism 60 includes pump 52, which is preferably a rotary pump for creating a negative pressure, although other pumps which achieve the same purpose may be utilized. Recovery mechanism 60 also includes print heads caps 47*a* and 47*b* for separately capping print heads 56*a* and 56*b*, respectively, in order to protect print heads 56*a* and 56*b* from the environment when not in use and in order to perform a suction recovery operation by utilizing pump 52 in order to draw residual ink and other contaminants from the discharge nozzles of print heads 56*a* and 56*b*. Wiper base 62 is also provided on recovery mechanism 60 in order to support wiper blade 46 (not shown) for wiping the discharge surface of print heads 56*a* and 56*b* in order to remove residual ink and other contaminants therefrom. Wiper blade cover 66 is provided in recovery mechanism 60 in order to cover wiper blade 46 when wiper blade 46 is not in use, thereby protecting wiper blade 46 from collecting residual ink during the printing process and/or during a prefire recovery operation.

Accordingly, wiper base 62 is slidably disposed in recovery mechanism 60 in order to slide back and forth in a travel path which is perpendicular to the travel path of carriage 45. In this manner, wiper base 62 is moved in a direction towards wiper blade cover 66 in order to place wiper blade 46 under wiper blade cover 66 when it is not in use. When wiper base 62 is in the position to place wiper blade 46 under wiper blade cover 66, it also serves the purpose of covering print head caps 47*a* and 47*b* in order to protect them in a manner similar to wiper blade 46 during printing operations and/or prefire operations of print heads 56*a* and 56*b*. Carriage lever 64 is provided in recovery mechanism 60 in order to raise carriage 45, and therefore print heads 56*a* and 56*b*, so as to maintain a fixed, predetermined height of print heads 56*a* and 56*b* over recovery mechanism 60 during recovery operations to provide effective performance of the recovery operations, such as wiping and capping, and also to prevent damage to print heads 56*a* and 56*b* during such recovery operations.

Figure 14:
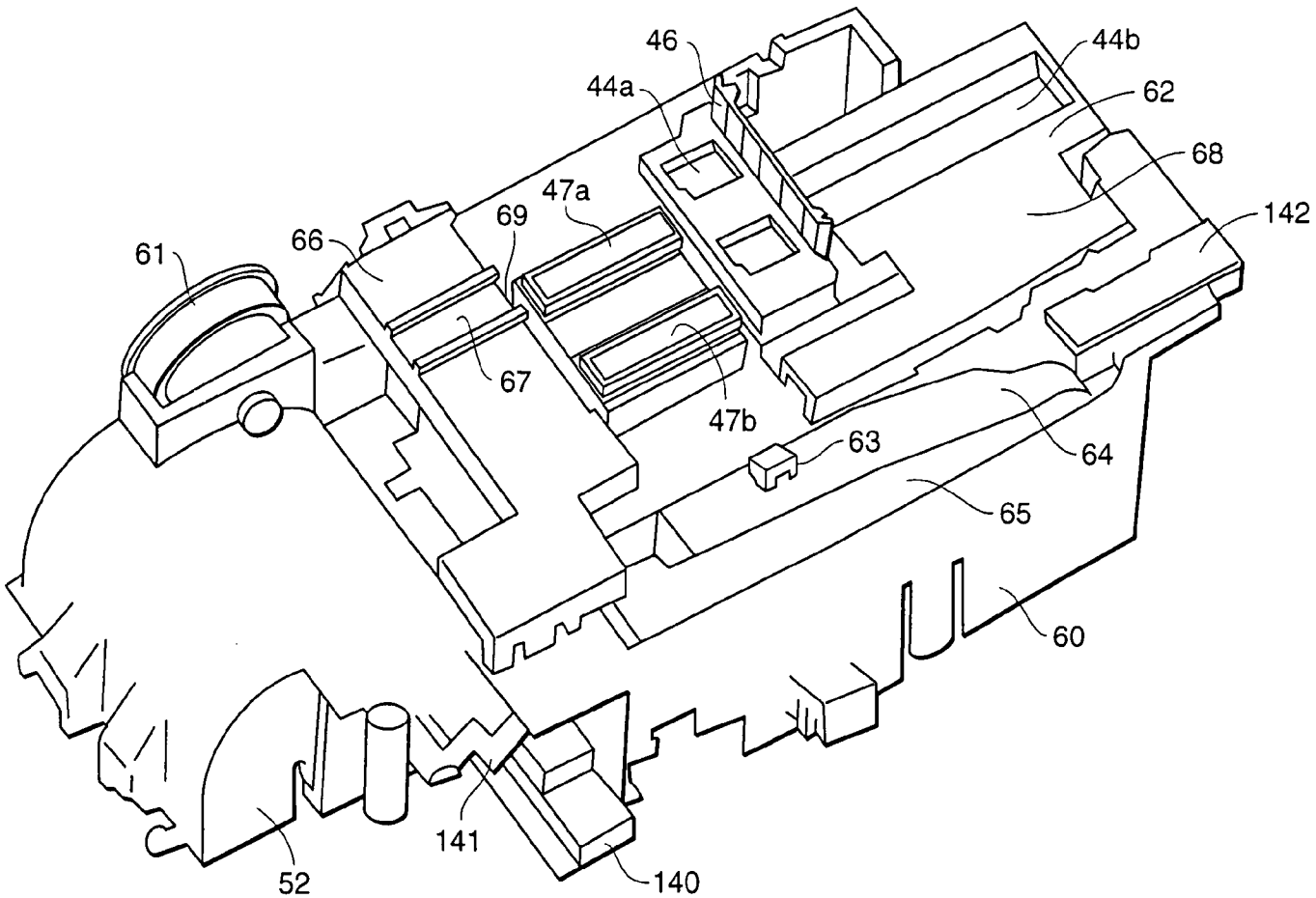
FIG. 14 is a detailed perspective view for explaining the components of the recovery mechanism according to one embodiment of the present invention.

FIG. 14 provides a detailed perspective view for explaining the components of recovery mechanism 60. In particular, it can be seen from FIG. 14 that pump 52 is driven by pump input gear 61 which is in turn driven by line feed shaft 36 via a gear train (not shown), wherein pump 52 is actuated by running line feed motor 34 in a reverse direction. In this regard, pump position arm 141 rotates to indicate a current position of pump 52, whereupon pump position sensor 140 detects the position of pump position arm 141 and reports this position by an electrical signal to sensors 103 on circuit board 35 of printer 10. Wiper blade cover 66 is provided on the top of recovery mechanism 60 and in the path of slidably-mounted wiper base 62 in order to cover wiper blade 46 as it is passed under wiper cover top surface 67. In this regard, wiper blade cleaner 69 is provided on a leading edge of wiper blade cover 66 in order to clean wiper blade 46 as it passes across the leading edge (not shown) of wiper blade cover 66. Print head caps 47*a* and 47*b* are supported by a capping mechanism (not shown) in order to raise and lower caps 47*a* and 47*b* to cap print heads 56*a* and 56*b*, respectively, when they are not in use or when a suction recovery operation is being performed. Capping mechanism 160 will be discussed in more detail below.

As previously discussed above, wiper base 62 performs several functions. As can be seen from FIG. 14, wiper base 62 supports wiper blade 46 for wiping print heads 56*a* and 56*b* as wiper base 62 is slidably moved back and forth. In addition, wiper base 62 includes prefire receptacle areas 44*a* and 44*b*, each of which corresponds to print heads 56*a* and 56*b*, respectively. It can be seen that prefire receptacle area 44*b* is provided on wiper base 62 in an area which is not directly over caps 47*a* and 47*b*. Prefire receptacle area 44*b* therefore has an opening to an open area within recovery mechanism 60 for receiving prefire ink from print head 56*a* during a prefire recovery operation, without contaminating caps 47*a* and 47*b*. Prefire receptacle area 44*a* is not open to an area below wiper base 62, but is comprised of a trough which generally runs the length of wiper base 62 and which contains a drain sheet of an absorbent fabric for collecting prefire ink therein.

Accordingly, wiper base 62 is positioned over caps 47*a* and 47*b* during a prefire recovery operation on print heads 56*a* and 56*b*, thereby collecting prefire ink from one of the print heads in prefire receptacle area 44*a* while allowing prefire ink from the other print head to be directed through an opening in prefire receptacle area 44*b* to freely fall to an open area within recovery mechanism 60. Therefore, prefire operations can be performed at the home position of carriage 45 with reduced contamination to caps 47*a* and 47*b* because they are covered by wiper base 62 during such operations. In addition, wiper base 62 is preferably moved to place wiper blade 46 under wiper blade cover 66 during prefire operations to also protect wiper blade 46 from ink contamination during such prefire operations. In such a situation, it can be appreciated that prefire ink from one of the print heads is collected in the portion of prefire receptacle area 44*a* on the other side of wiper blade 46, and the prefire ink from the other print head is simply allowed to fall into an area of recovery mechanism 60 which is adjacent to wiper base 62, thereby preventing contamination of caps 47*a* and 47*b* and wiper blade 46 during prefire recovery operations.

Accordingly, wiper cover top surface 67 is utilized to protect wiper blade 46 and wiper base top surface 68 is utilized to protect caps 47*a* and 47*b* during non-use and during certain recovery operations. Therefore, a prefire recovery operation can be performed directly over recovery mechanism 60 with reduced contamination of caps 47*a* and 47*b* and wiper blade 46. As shown in FIG. 14, carriage lever 64 is disposed on one side of recovery mechanism 60 to raise carriage 45 to a predetermined height above recovery mechanism 60 to accommodate recovery operations or capping of print heads 56*a* and 56*b* during non-use. In this regard, carriage lever support 65 is also provided in recovery mechanism 60 in order to raise and lower carriage lever 64. Lock pin 63 is provided on the upper surface of carriage lever 64 in order to engage a corresponding pin receptacle in carriage 45 (not shown) to prevent carriage 45 from moving along its lateral travel path while carriage 45 is located over recovery mechanism 60 during recovery operations or simply during capping, such as when the printer is not being used or during transportation of the printer. Recovery cam sensor 142 is utilized to sense a position of recovery cam 144 (not shown) for informing printer 10 of the operational mode of recovery mechanism 60.

Figure 15:
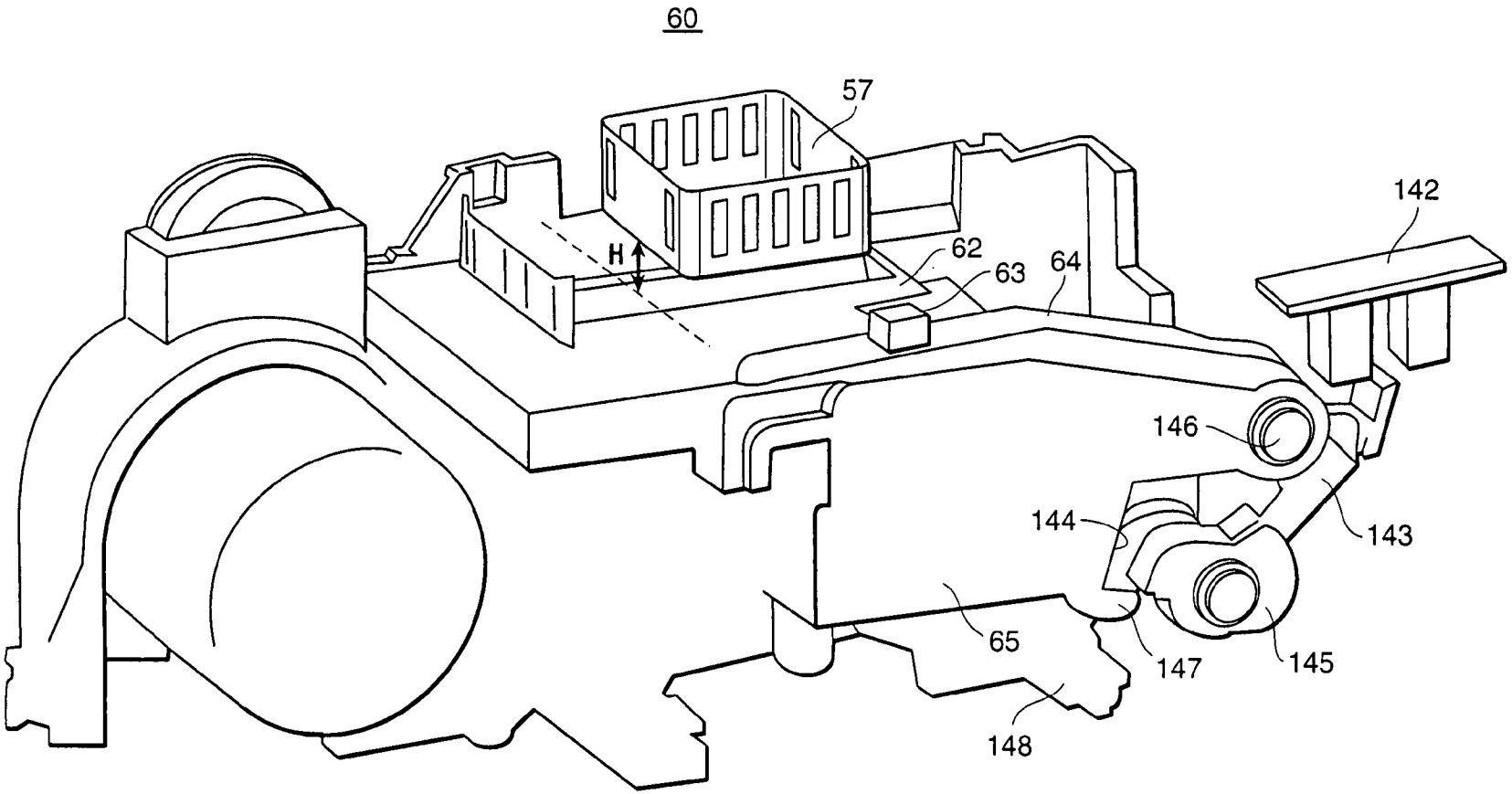
FIG. 15 is a detailed perspective view for explaining the operation of the carriage lever in the recovery mechanism according to one embodiment of the present invention.

FIG. 15 provides a detailed perspective for explaining the operation of carriage lever 64 to raise and lower carriage 45 when carriage 45 is in the home position over recovery mechanism 60. During recovery operations, and during simple capping, of print heads 56*a* and 56*b*, it is desired that the distance of print heads 56*a* and 56*b* over recovery mechanism 60 be maintained at a predetermined height H as depicted in FIG. 15. Print head cover 57 is shown in FIG. 15 to be located at a fixed, predetermined height H above wiper base 62, which serves as a reference point for recovery mechanism 60. In this regard, carriage lever 64 is rotatably mounted on recovery mechanism 60 about shift pivot point 146 in order to allow carriage lever 64 to rotate up and down in a vertical direction in order to engage carriage 45 and move carriage 45 to the predetermined height H when carriage 45 is located over recovery mechanism 60. As previously mentioned, lock pin 63 is utilized to engage a corresponding pin receptacle on carriage 45 to prevent carriage 45 from traveling in a lateral direction while engaged by carriage lever 64.

Carriage lever support 65 is utilized to rotate carriage lever 64 about shift pivot point 146 in order to engage and move carriage 45. Carriage lever support 65 is also rotatably mounted on recovery mechanism 60 about shift pivot point 146 and is driven by shift cam 145. Shift cam 145 is driven by recovery cam 144 which is in turn driven by a gear train (not shown) and ASF motor 41. Carriage lever support 65 has cam following portion 147 which follows the contour of shift cam 145, thereby forcing carriage lever support 65 to rotate in an upward direction when the extended portions of shift cam 145 engage cam following portion 147. When carriage lever support 65 is rotated in the upward direction, it engages carriage lever 64 and causes it to also rotate upward for engaging and moving carriage 45 to the desired predetermined height. Recovery cam position arm 143 is provided to indicate the position of recovery cam 144 to recovery cam sensor 142 so that the operational state of recovery mechanism 60 can be reported to printer 10 for control purposes. Also shown in FIG. 15 is wiper gear mechanism 148 which is also driven by recovery cam 144 in order to slidably move wiper base 62 for wiping operations and for covering print head caps 47*a* and 47*b*.

FIGS. 16A and 16B are views for explaining a mechanism for adjusting the vertical position of carriage 45 during printing. It is generally desired to have print heads 56*a* and 56*b* located at a fixed height above the printing medium during printing, for optimal printing results. Accordingly, as seen in FIG. 16A, carriage 45 has gap lever 150 disposed thereon to position carriage 45 to a desired height above the recording medium during printing. In this regard, gap lever 150 is generally comprised of a lever with gap lever cam 151 at one end which is rotatably mounted on carriage 45. As seen in FIG. 16B, gap lever cam 151 is disposed against a guide rail of chassis 64, thereby rotating carriage 45 about guide shaft 51 as gap lever 150 is rotated to press a different section of gap lever cam 151 against the guide rail of chassis 54. In this manner, a user of printer 10 can adjust the vertical position of carriage 45 above the recording medium for optimal printing results based on the type of recording medium being used.

Figure 17A:
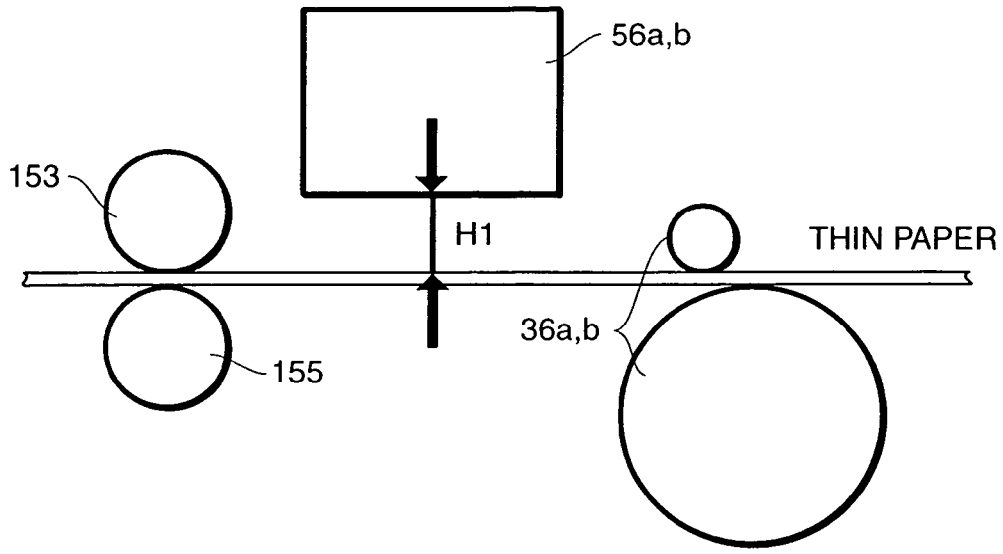
FIG. 17*a* is a block diagram for illustrating a position of the carriage for printing on thin paper according to one embodiment of the present invention.
Figure 17B:
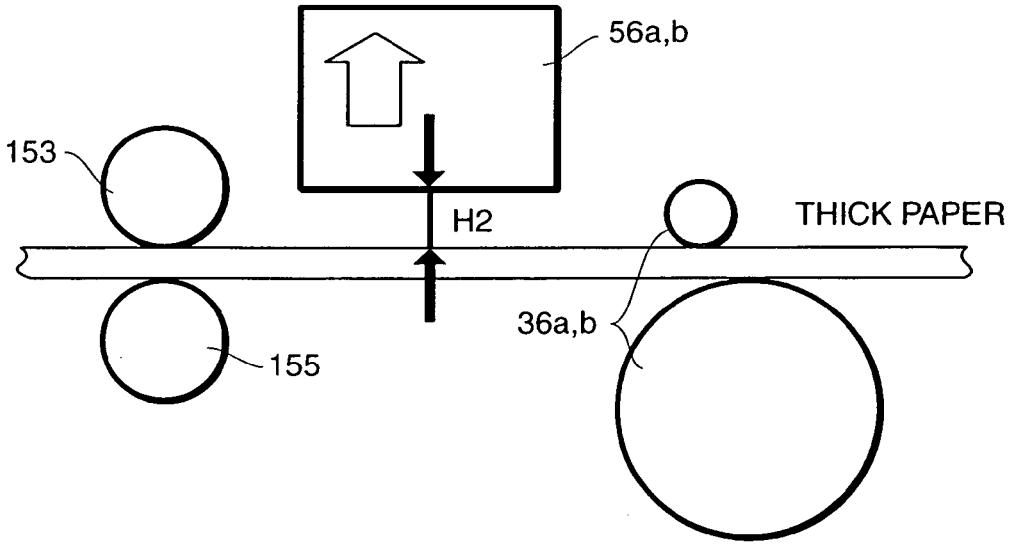
FIG. 17*b* is a block diagram for illustrating adjustment of the carriage position for printing on thick paper according to one embodiment of the present invention.

FIGS. 17A and 17B provide an illustration of the effectiveness of utilizing gap lever 150 during a printing operation. Specifically, in FIG. 17A, the recording medium being used is a thin paper and is passed along the printing travel path through line feed rollers 36*a* and 36*b* and then through spur roller 153 and eject roller 155 in order to pass the thin paper under print heads 56*a* and 56*b*. Line feed roller 35*a* and eject roller 155 are assembled in predetermined positions. Pinch roller 36*b* and spur roller 153 are pushed by a spring (not shown) in a direction which is perpendicular to the paper feeding direction, to make a feeding force by friction. Accordingly, pinch roller 36*b* and spur roller 153 can move, and their positions depend on the thickness of the paper being used. When thin paper is utilized, as in FIG. 17A, a greater distance H1 is created between print heads 56*a* and 56*b*.

In the alternative, if thick paper is being used during printing, the thickness of the paper reduces the distance between the paper and print heads 56*a* and 56*b*. Accordingly, it is desired to move print heads 56*a* and 56*b* upward to reach the desired height of H1 as depicted in FIG. 17A. Therefore, the user of printer 10 can utilize gap lever 150 in order to adjust the vertical position of carriage 45 during printing to account for the type of recording medium being used during printing, to achieve optimal printing results.

Figure 18:
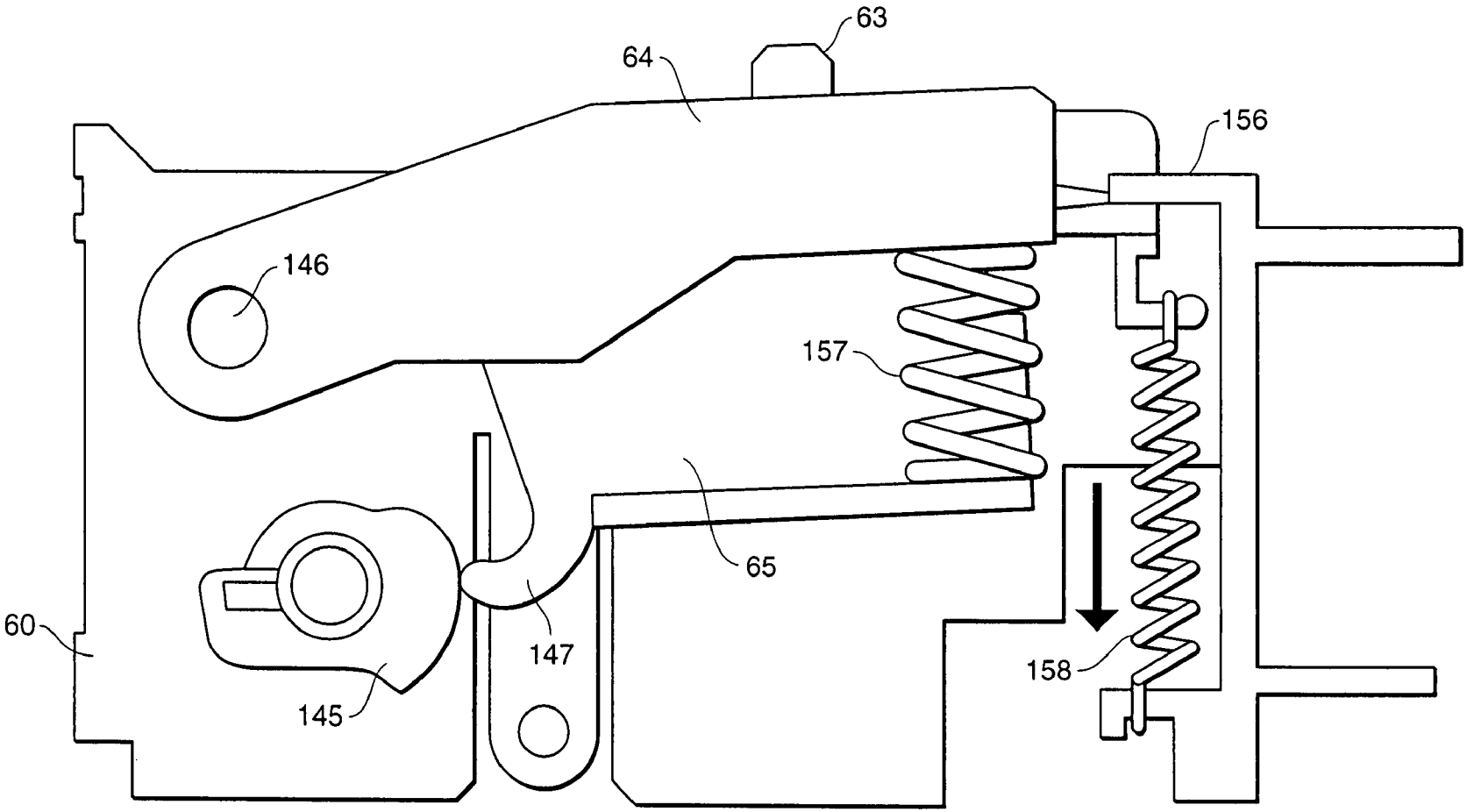
FIG. 18 is a cutaway side view for explaining the operation of the carriage lever in the recovery mechanism according to one embodiment of the present invention.

Regardless of the height of carriage 45 during printing, it is desired to maintain a fixed, predetermined height of print heads 56*a* and 56*b* during recovery operations and during simple capping. FIG. 18 provides a cutaway side view for explaining the operation of carriage lever 64. As previously mentioned, carriage lever 64 and carriage lever support 65 are rotatably mounted about shift pivot point 146 and are driven in an upward direction by rotation of shaft cam 145 via cam following portion 147 of carriage lever support 65.

As seen in FIG. 18, carriage lever spring 157 is disposed in between opposing ends of carriage lever 64 and carriage lever support 65. Accordingly, upward rotation of carriage lever support 65 imparts force upon carriage lever 64 through carriage lever spring 157 in order to drive carriage lever 64 in an upward direction to engage and move carriage 45 to the desired predetermined height. In this regard, recovery mechanism 60 has limiting post 156 which serves to catch one end of carriage lever 64 as carriage lever 64 travels in an upward direction to prevent carriage lever 64 from moving carriage 45 to a distance greater than the desired predetermined height above recovery mechanism 60. In this manner, the upward movement of carriage lever 64 is limited so as to obtain the desired predetermined height of carriage 45 and also to prevent damage to print heads 56*a* and 56*b* by carriage lever 64. Carriage lever return spring is connected to one end of carriage lever support 65 and is connected at the other end to recovery mechanism 60, therefore creating tension between recovery mechanism 60 and carriage lever support 65 so as to provide a biasing force to carriage lever support 65 in a downward direction.

In this manner, carriage lever support 65 and carriage lever 64 are always biased in a downward direction so as to return them to a low position within recovery mechanism 60 when they are not being driven upward by shift cam 145. By ensuring that carriage lever 64 and carriage lever support 65 are returned to a low position during non-use, they are kept out of the travel path of carriage 45, thereby preventing undesired contact with print heads 56*a* and 56*b* and possible damage thereto.

Figure 19:
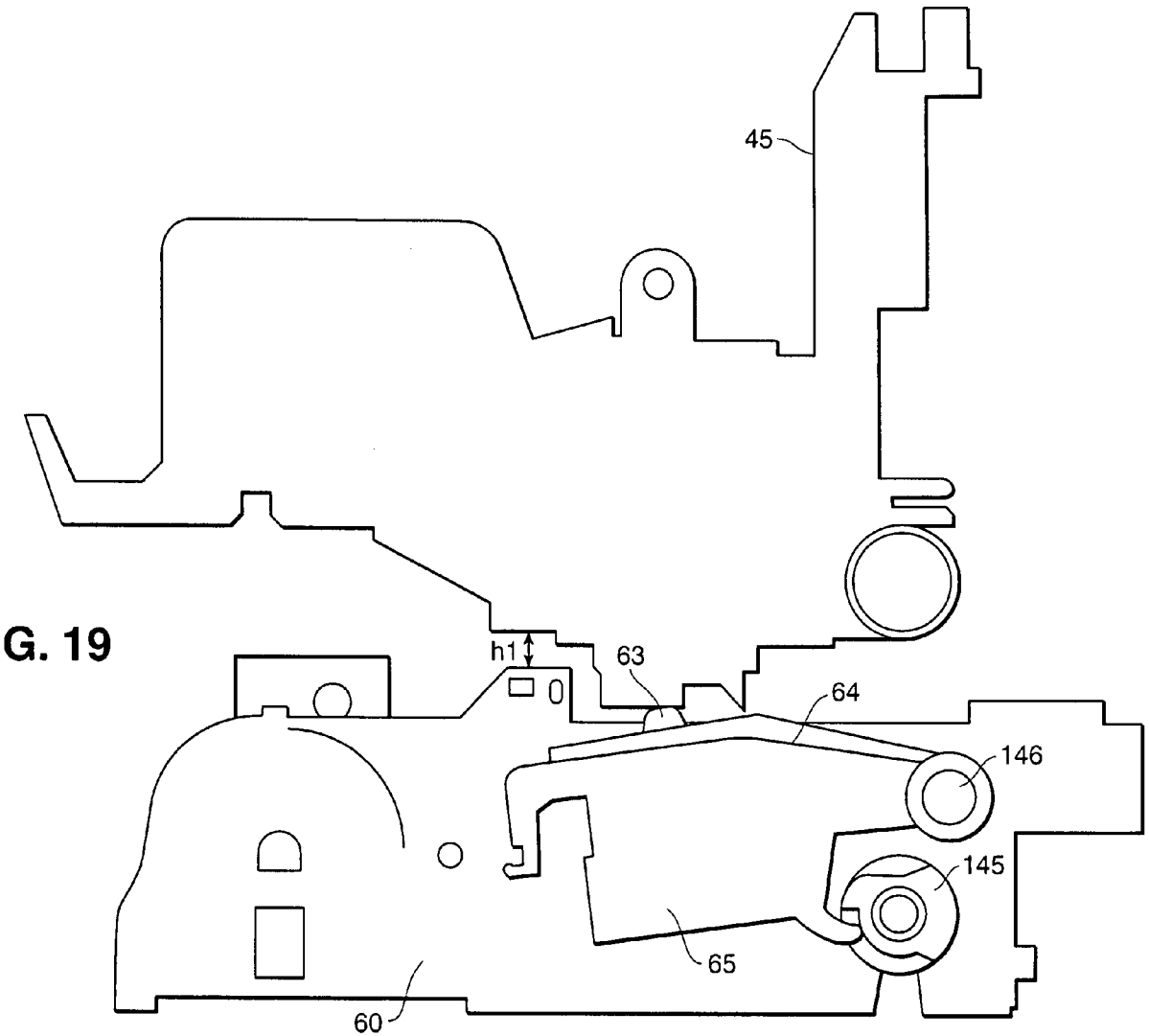
FIG. 19 is a cutaway side view for illustrating a lowered position of the carriage lever in the recovery mechanism according to one embodiment of the present invention.
Figure 20:
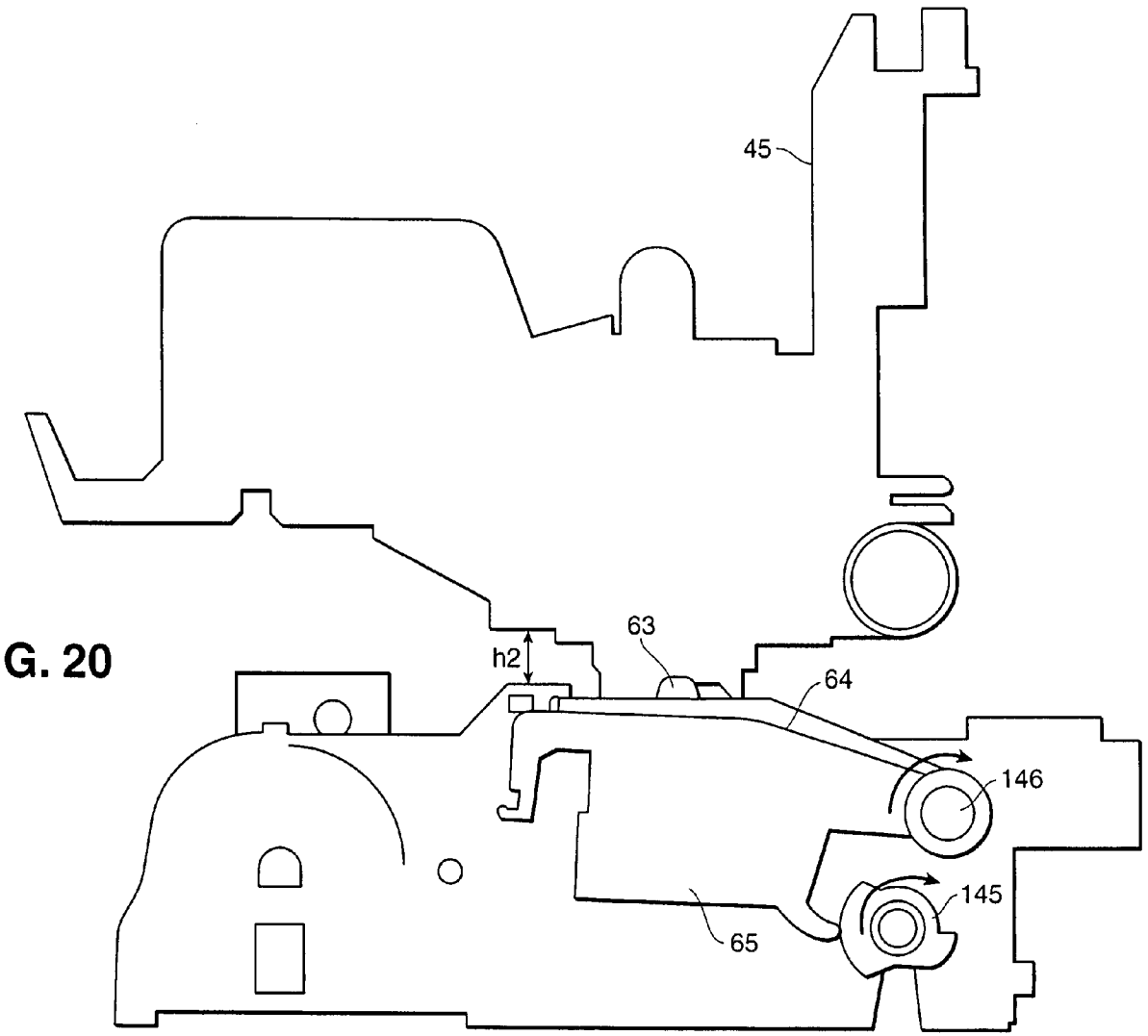
FIG. 20 is a cutaway side view for illustrating a raised position of the carriage lever in the recovery mechanism according to one embodiment of the present invention.

In this regard, FIGS. 19 and 20 provide illustrations of carriage lever 64 in a lowered position and in a raised position, respectively. As can be seen in FIG. 19, shift cam 145 has been rotated to a position having a thin contour, thereby allowing carriage lever support 65 to be biased in the downward direction by carriage lever return spring 158 so as to force carriage lever 64 and carriage lever support 65 to a lowered position. Accordingly, carriage lever 64 and lock pin 63 are not engaged with carriage 45, thereby leaving carriage 45 at its printing height indicated by H1 with respect to recovery mechanism 60.

On the other hand, in FIG. 20, shift cam 145 has been rotated in a clockwise direction in order to rotate carriage lever support 65 in a clockwise direction so that it is raised in a vertical direction along with carriage lever 64 through carriage lever spring 157 to a raised position. Accordingly, carriage lever 64 and lock pin 63 have engaged carriage 45 in FIG. 20 and raised it to a fixed, predetermined height H2 for performing recovery operations and for capping. The position of carriage lever 64 is determined by limiting post 156 and the position of carriage support lever 65 is determined by shift cam 145. Carriage lever 64 supports carriage 45 at the predetermined position and is shifted upward by carriage lever spring 157. Therefore, carriage lever spring 157 should be strong enough to support carriage 45 and print heads 56*a* and 56*b*. In this regard, carriage lever spring 157 plays a significant role in dampening the driving force of carriage lever support 65 against carriage lever 64 so as to dampen the force of carriage lever 64 against carriage 45. In this manner, unnecessary force from carriage lever 64 against carriage 45, and possibly against print heads 56*a* and 56*b*, is reduced by the dampening effect of carriage lever spring 157.

Figure 21:
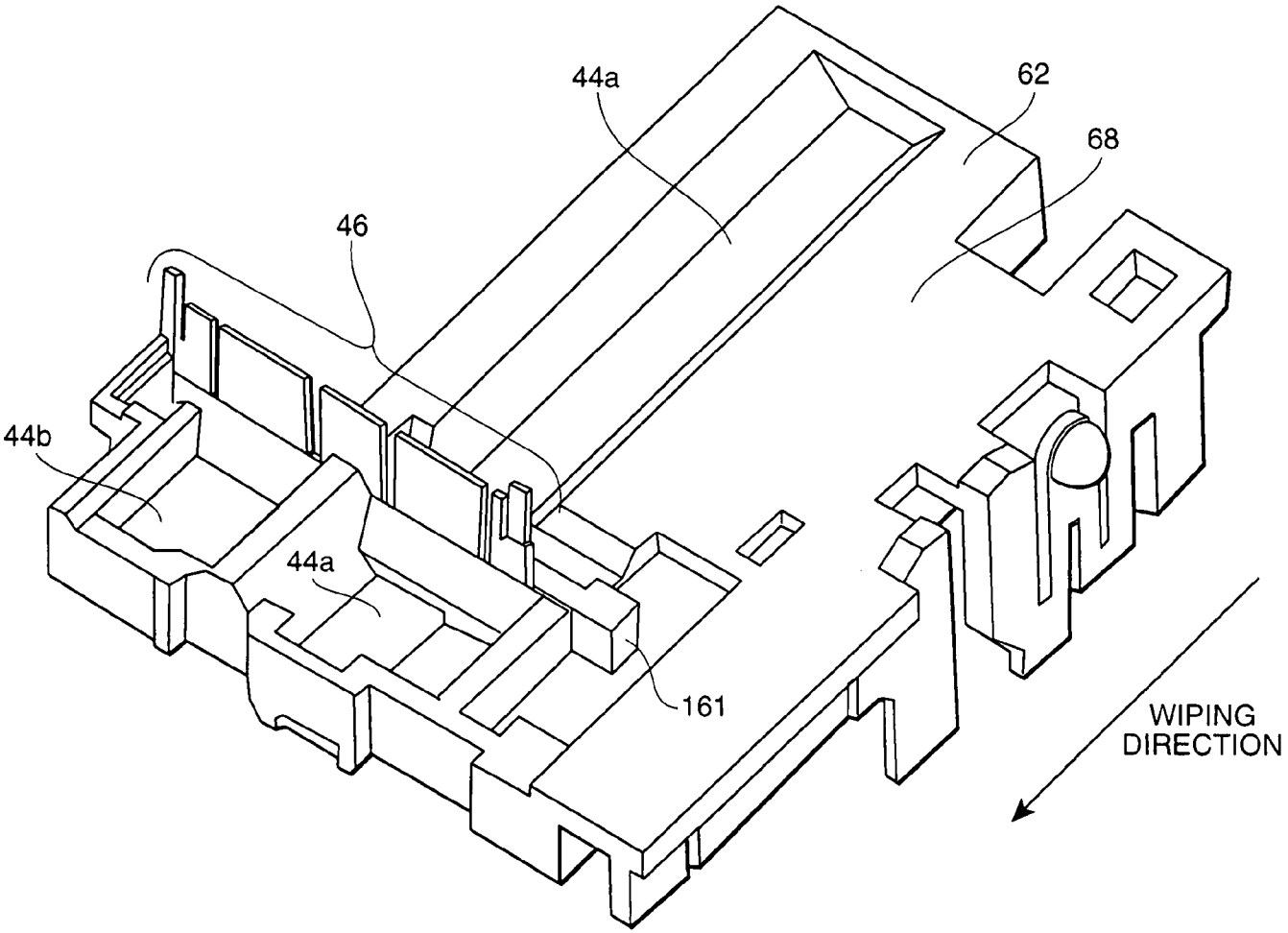
FIG. 21 is a perspective view for explaining the wiper base according to one embodiment of the present invention.

FIG. 21 is a view for explaining the components on wiper base 62. As previously discussed, wiper base 62 includes wiper base top surface 68 which serves to protect caps 47*a* and 47*b* when wiper base 62 is positioned over the caps. Wiper blade 46 is positioned on wiper base 62 in a planar direction which is perpendicular to the slidable travel path of wiper base 62. Wiper blade 46 is held in position on wiper base 62 by wiper stay 161. Also as previously mentioned, prefire receptacle areas 44*a* and 44*b* are provided on wiper base 62. As can be seen from FIG. 21, prefire receptacle area 44*b* consists only of an opening on the front side of wiper base 62 such that prefire receptacle area 44*b* encounters its respective print head immediately before wiper blade 46 encounters the same print head as wiper base 62 is slidably translated in a forward direction toward wiper blade cover 66 (not shown).

Prefire receptacle area 44*b* does not have a corresponding portion on the other side of wiper blade 46, and therefore prefire ink discharged from the print head corresponding to prefire receptacle area 44*b* simply falls into an open area within recovery mechanism 60 after wiper blade 46 passes the print head in the wiping direction. Prefire receptacle area 44*a* runs the length of wiper base 62, thereby having a portion on the front side of wiper base 62 (e.g., in front of wiper blade 46), and a portion on the back side of wiper base 62. This is because prefire receptacle area 44*a* is aligned for the right-most print head which would be positioned directly over caps 47*a* and 47*b* during prefire recovery operations. Accordingly, wiper base top surface 68 and prefire receptacle area 44*a* serve to prevent contamination of cap 47*a* and 47*b* during prefire operations and to prevent such ink contamination to other parts of recovery mechanism 60 and printer 10 during such operations.

In addition, the positioning of prefire receptacle areas 44*a* and 44*b* on wiper base 62 such that they are in alignment with wiper blade 46, allows concurrent operations of performing prefire from each of print heads 56*a* and 56*b* while wiper base 62 is translating in the wiping direction as indicated in FIG. 21. Therefore, a wiping operation can be performed across print heads 56*a* and 56*b* as they perform prefire ejection of ink into corresponding prefire receptacle areas 44*a* and 44*b*.

Figure 22:
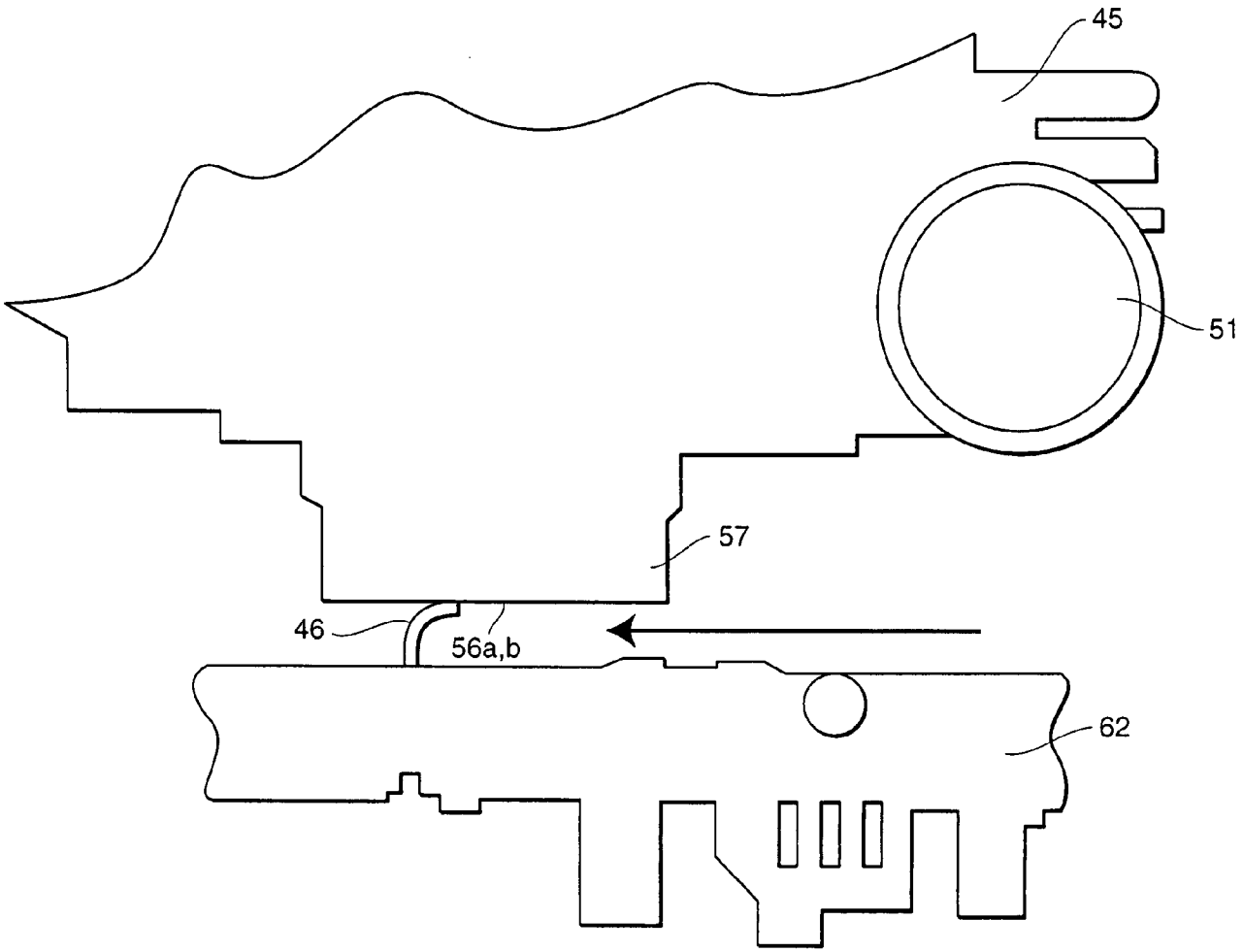
FIG. 22 is a section view illustrating a wiping operation according to one embodiment of the present invention.

FIG. 22 is a section view for explaining a wiping operation according to the foregoing mechanism. As can be seen in FIG. 22, carriage 45 is located in the home position at the predetermined height over recovery mechanism 60 while wiper base 62 is slidably translated in a direction across print heads 56*a* and 56*b* which is perpendicular to the carriage travel path dictated by guide shaft 51. In this manner, wiper blade 46 encounters a front edge of print heads 56*a* and 56*b*, respectively, and then sequentially wipe across the discharge surfaces of each print head, thereby wiping residual ink and contaminants from the discharge orifice of each print head.

Figure 23A:
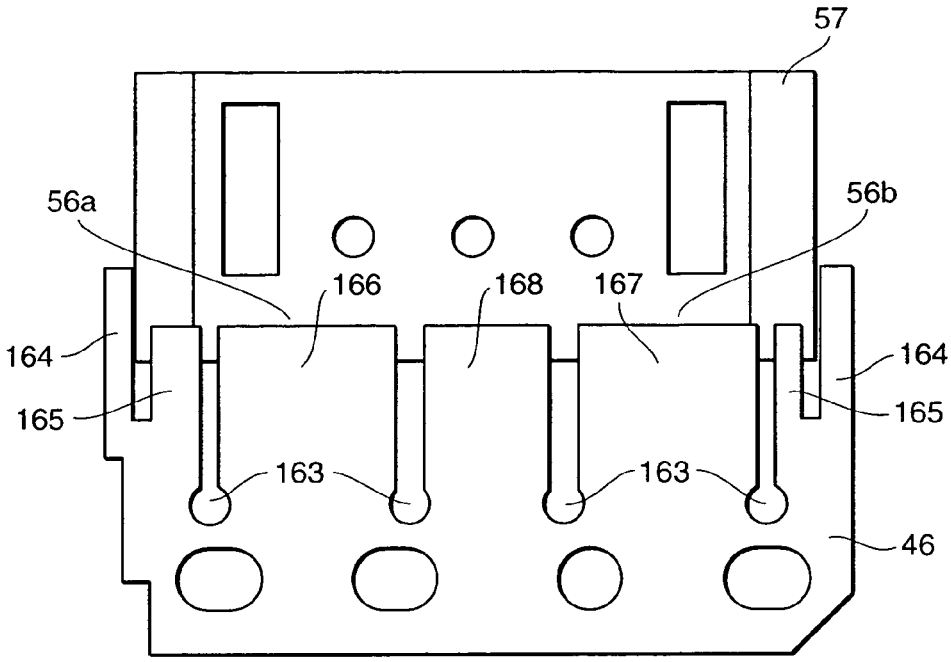
FIGS. 23A and 23B are a front view and a plan view, respectively, for illustrating a wiping operation according to one embodiment of the present invention.
Figure 23B:
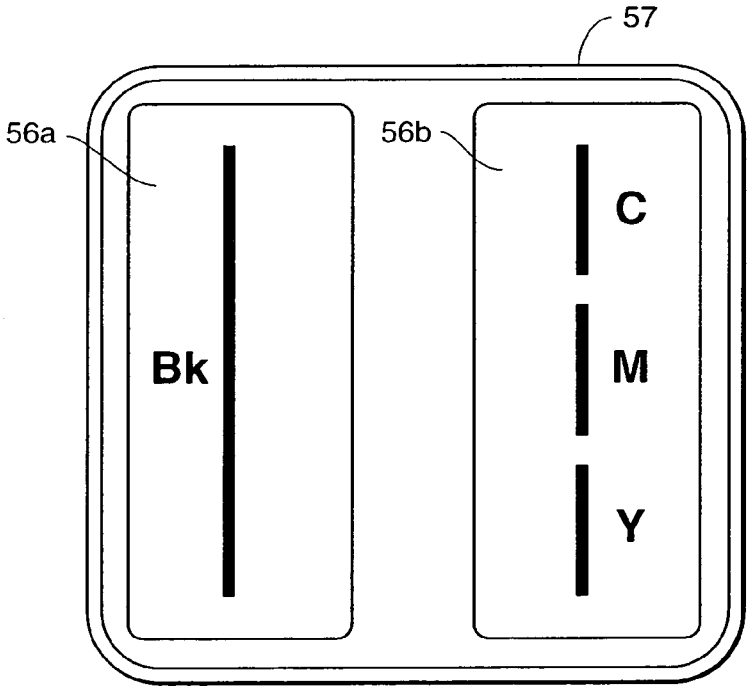

FIGS. 23A and 23B are views for further explaining a wiping operation according to the present invention. According to FIG. 23A, print head cover 57 is shown in which print heads 56*a* and 56*b* are disposed, wherein each print head has a discharge surface portion with a corresponding set of discharge nozzles for ejecting ink therein. Wiper blade 46 is shown in FIG. 23A wherein a plurality of slits 163 partition wiper blade 46 into a plurality of blade portions. As can be seen in FIG. 23A, each blade portion wipes a respective discharge surface portion of print heads 56*a* and 56*b*. Specifically, wiper blade 46 is partitioned into two flap-side blade portions 164 disposed at the outer edges of wiper blade 46, two flap-edge blade portions 165 located adjacent to flat-side blade portions 164, first nozzle blade portion 166 located adjacent to one of flap-edge blade portion 165, second nozzle blade portion 167 located adjacent to the other flap-edge blade portion 165, and middle blade portion 168 located in the middle of wiper blade 46.

In particular, flap-side blade portions 164 are utilized to wipe the outer corners and edges of print head cover 57, flap-edge blade portions 165 are utilized to wipe the bottom edges of print head cover 57 which are parallel to the discharge surfaces of print heads 56*a* and 56*b*. First nozzle blade portion 166 is utilized to wipe the main discharge surface of print head 56*a*, and second nozzle blade portion 167 is utilized to wipe the main discharge surface of print head 156*b*. Middle blade portion 168 is utilized to wipe an area in between print heads 56*a* and 56*b* so as to wipe the area that may be contaminated with ink from both print heads 56*a* and 56*b*. For this reason, middle blade portion 168 is isolated from first nozzle blade portion 166 and second nozzle blade portion 167 in order to prevent any cross-contamination of ink on these respective blade portions, thereby preventing cross-contamination of ink on each of print heads 56*a* and 56*b* during a next wiping operation.

Figure 24A:
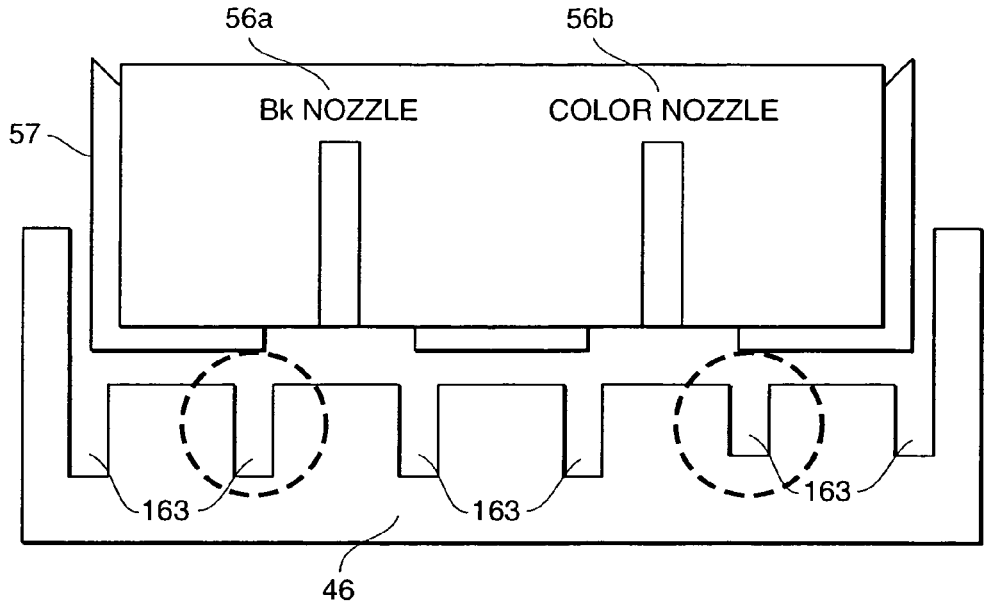
FIGS. 24A, 24B and 24C are front views for illustrating a shift wiping operation according to one embodiment of the present invention.
Figure 24B:
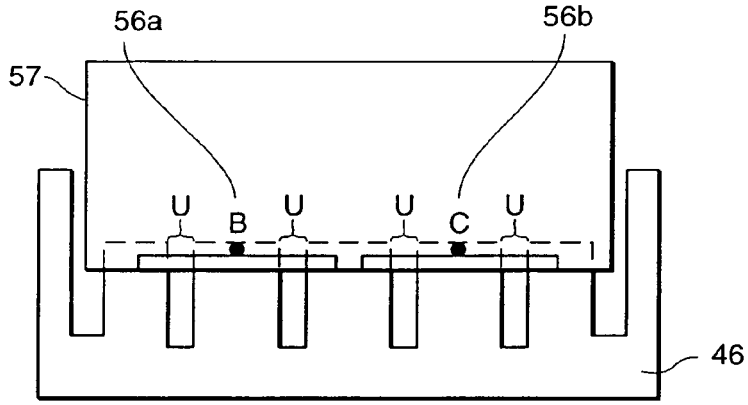
Figure 24C:
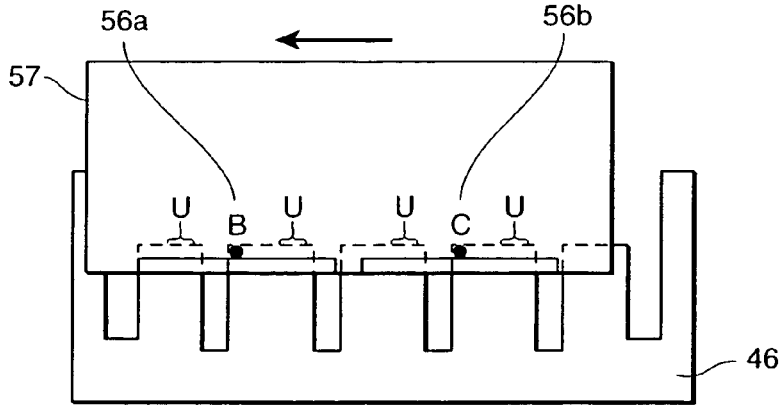

Turning to FIG. 23B, a plan view of print heads 56*a* and 56*b* within print head cover 57 is illustrated. As can be seen, first nozzle blade portion 166 is dedicated to wiping, in a sequential fashion from front to back, all ink discharge nozzles of print head 56*a* which ejects black ink. In a similar fashion, second nozzle blade portion 167 is dedicated to wiping each set of colored discharge nozzles of print head 56*b* which discharges the colored inks cyan, magenta and yellow. FIGS. 24A, 24B and 24C provide front views for illustrating a shift wiping operation.

Specifically, FIG. 24A depicts wiper blade 46 as it approaches print heads 56*a* and 56*b* to wipe the discharge surfaces thereof during a wiping operation. As can be seen from FIG. 24A, each of the blade portions of wiper blade 46 is utilized to fit the uneven discharge surface of print heads 56*a* and 56*b* and to prevent contamination of inks between the respective print heads. As illustrated, each of wiper slits 163 allows the separate blade portion adjacent thereto to wipe a corresponding discharge surface portion without affecting its neighboring blade portion.

Turning to FIG. 24B, it can be seen that the plurality of wiper slits 163 have the potential to leave small spaces of unwiped portions on the discharge surfaces of print heads 56*a* and 56*b* as indicated by those portions marked "U". Therefore, in order to thoroughly clean the surface of print heads 56*a* and 56*b*, a shift wiping operation is utilized wherein carriage 45 is shifted a slight amount and then a second wiping is performed so that each of the blade portions of wiper blade 46 wipes the previously unwiped areas. For example, as seen in FIG. 24B, wiper blade 46 wipes print heads 56*a* and 56*b* in a first wiping position, thereby leaving four unwiped areas corresponding to wiper slits 163. Next, carriage 45 is shifted slightly to the left, as shown in FIG. 24C, thereby moving print heads 56*a* and 56*b* to a second wiping position with respect to wiper blade 46. Then, wiper blade 46 wipes the discharge surfaces of print heads 56*a* and 56*b* so as to wipe the four previously unwiped areas because the blade portions of wiper blade 46 are now positioned over the unwiped areas.

As previously mentioned, the position of prefire receptacle areas 44*a* and 44*b* on wiper base 62 allow print heads 56*a* and 56*b* to perform prefiring of ink while also being wiped by wiper blade 46 as wiper base 62 is translated across print heads 56*a* and 56*b*.

Figure 25A:
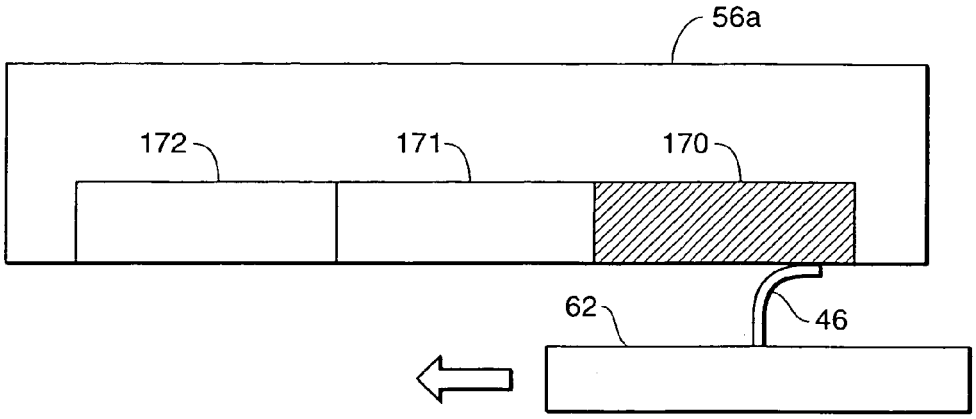
FIGS. 25A, 25B and 25C are views for explaining concurrent prefire and wipe operations according to one embodiment of the present invention.
Figure 25B:
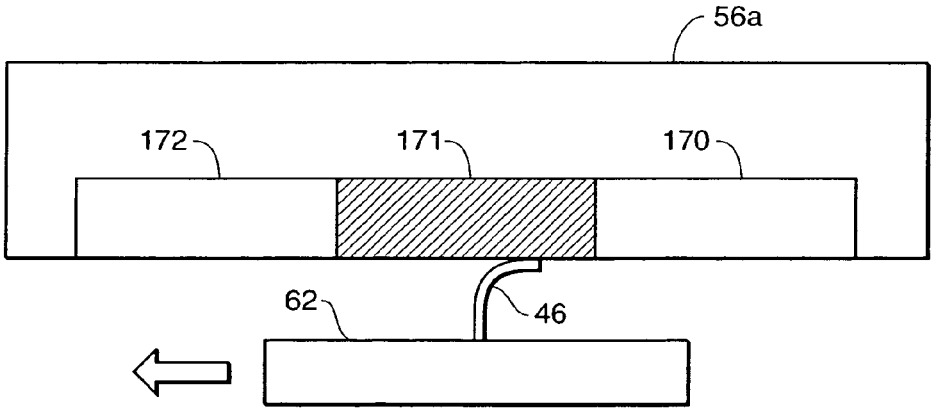
Figure 25C:
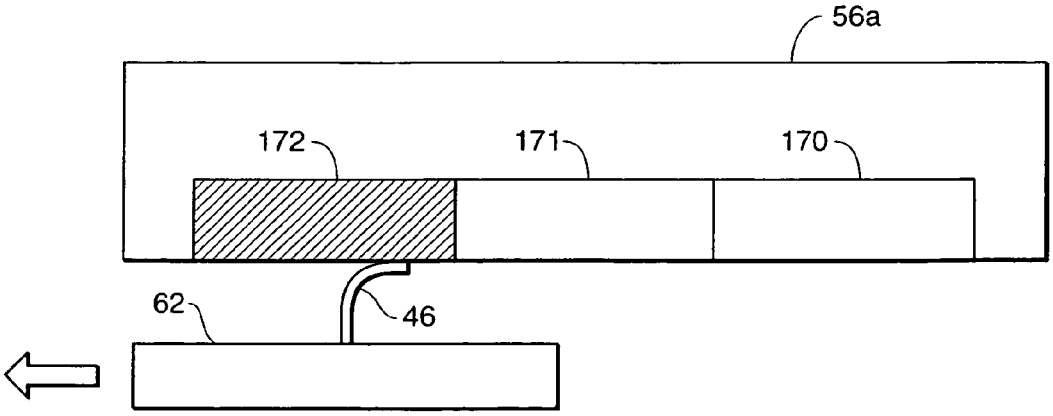

FIGS. 25A, 25B and 25C illustrate concurrent wiping and prefire operations. As depicted in FIG. 25A, wiper base 62 is translated in a forward direction across print head 56*a* and also 56*b* (not shown). As can be seen in FIG. 25A, the discharge surface of print head 56*a* is arranged in a plurality of nozzle sections 170, 171 and 172. For example, referring to FIG. 23B, each of nozzle sections 170 to 172 may correspond to the cyan, magenta and yellow nozzle sections of print head 56*b*. In the alternative, each of nozzle sections 170 to 172 may correspond to one-third of the discharge nozzles of print head 56*a*. In any event, concurrent prefiring is performed while wiping is also performed. First, in FIG. 25A, first nozzle section 170, identified by hatched lines, is engaged in a prefire operation in which it ejects ink from the discharge nozzles in its section to remove residual ink and contaminants. As the prefire discharge is occurring, preferably from the right-most nozzle to the left-most nozzle sequentially, wiper blade 46 translates across the discharge surface of first nozzle section 170 in the direction of the arrow in FIG. 25A.

Therefore, the discharge nozzles of first nozzle section 170 are provided with fresh ink during the prefire operation to help dissolve any residual ink in the discharge orifices and on the discharge surface so as to make wiping by wiper blade 46 more effective. This procedure is continued sequentially with each of nozzle sections 171 and 172 as shown in FIGS. 25B and 25C, respectively. Accordingly, only one nozzle section is performing prefire at a time, as indicated by the hatched lines. In this manner, ink is provided to the corresponding discharge nozzles of each corresponding nozzle section immediately before wiping by wiper blade 46. Efficient and effective wiping is thereby achieved. In addition, as wiper base 62 translates across print heads 56*a* and 56*b* to perform wiping in this manner during prefire operations, the prefired ink is received in prefire receptacle areas 44*a* and 44*b*, respectively, to prevent contamination to caps 47*a* and 47*b*, and other components.

Figure 26:
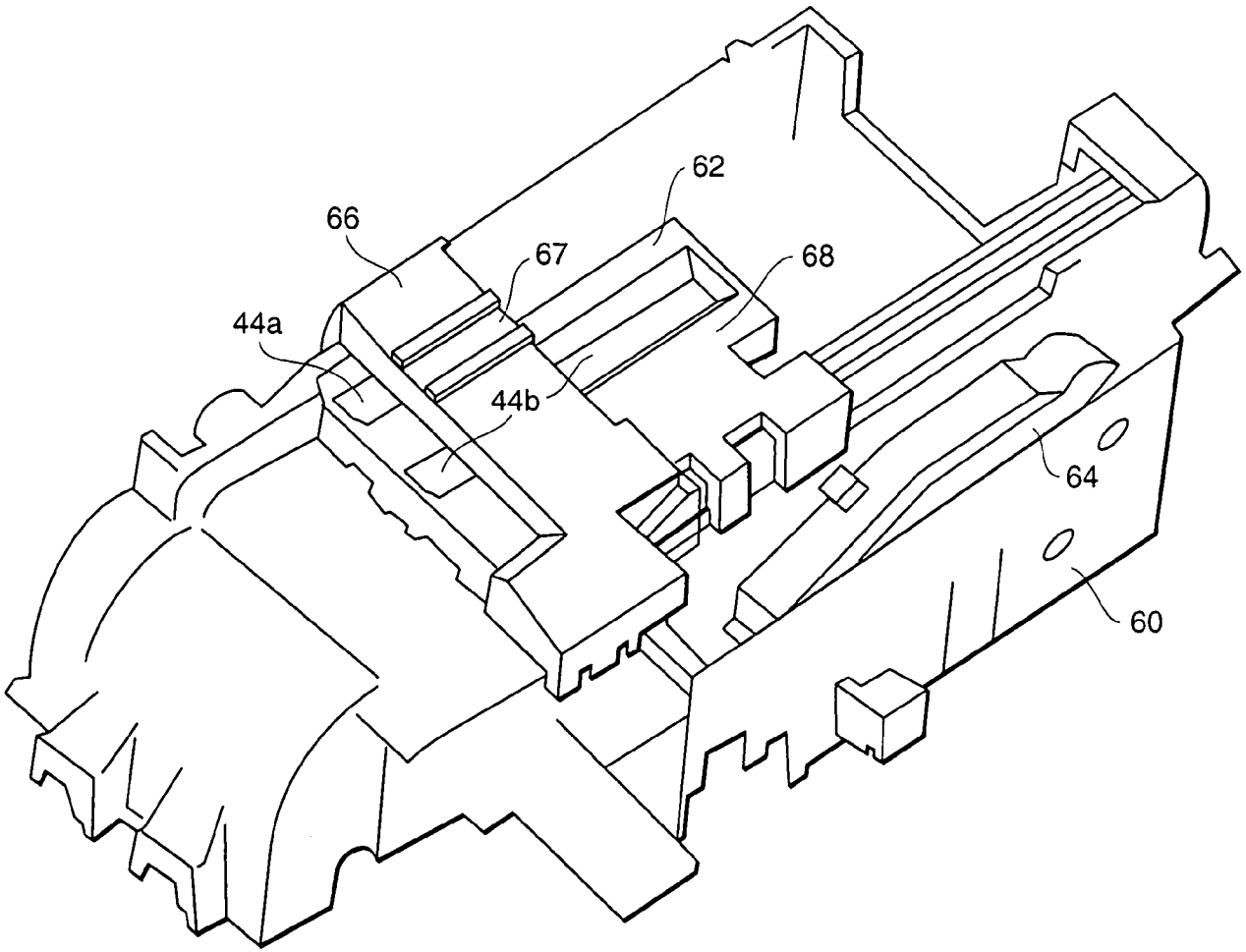
FIG. 26 is a view for illustrating the print heads and wiper blade in a covered position according to one embodiment of the present invention.

FIG. 26 provides a view of recovery mechanism 60 when wiper base 62 is slidably translated to a full-forward position in which wiper based top surface 68 covers print head caps 47*a* and 47*b*, and wiper cover cap surface 67 of wiper blade cover 66 covers wiper blade 46. Such a condition may be utilized during a prefire operation in which wiping is not desired to be performed concurrently. As seen in FIG. 26, carriage lever 64 is in a lowered condition for printing.

Figure 27A:
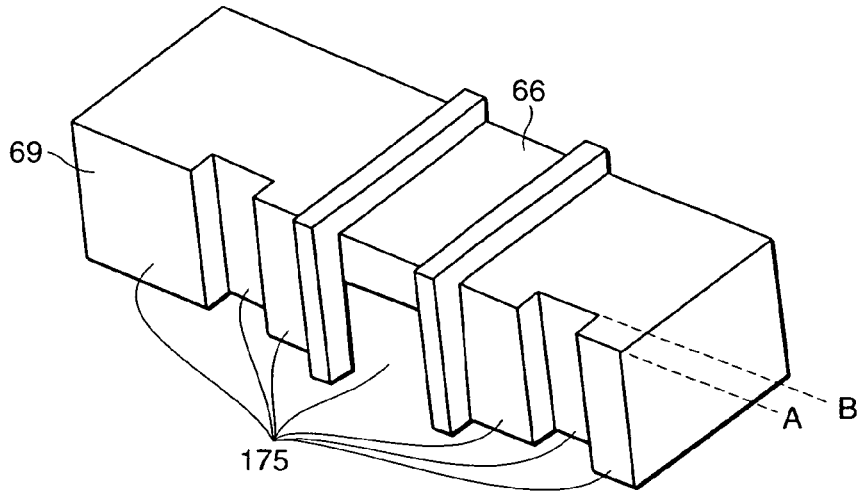
FIGS. 27A, 27B and 27C are views for explaining a wiper blade cleaner according to one embodiment of the present invention.
Figure 27B:
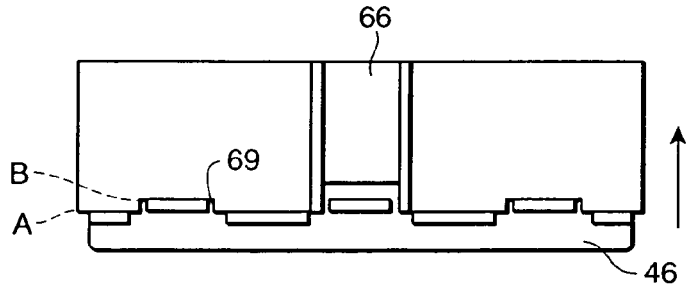
Figure 27C:
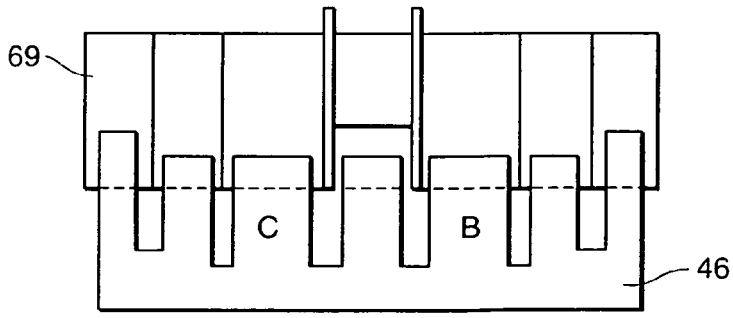

FIGS. 27A, 27B and 27C illustrate wiper blade cleaner 69. In FIG. 27A, wiper blade cleaner 69 is shown as being disposed on the front surface of wiper blade cover 66 so as to encounter wiper blade 46 as wiper base 62 is translated toward wiper blade cover 66. Specifically, wiper blade cleaner 69 has a plurality of cleaning sections 175 for cleaning each of the blade portions of wiper blade 46, respectively. As can be seen in FIG. 27A, the middle cleaning surface section is comprised of an open gap, thereby allowing middle blade portion 168 to pass therethrough without being cleaned by wiper blade cleaner 69. This is so that middle blade portion 168 cannot cause cross-contaminated ink from both of print heads 56*a* and 56*b* to become airborne when encountering wiper blade cleaner 69. In this manner, each of first nozzle blade portion 166 and second nozzle blade portion 167 which are adjacent to middle blade portion 168 are protected from cross-contamination of different inks during cleaning of wiper blade 46 by wiper blade cleaner 69.

It can also be seen by viewing FIG. 27A that two of the cleaning surface sections of wiper blade cleaner 69 are recessed to the depth indicated by level B, while the other cleaning surface sections are located at the front edge, indicated by level A. Turning to FIG. 27B, which provides a top-down view of wiper blade cleaner 69 during cleaning of wiper blade 46, it can be seen that flap-edge blade portions 165 did not encounter their respective cleaning surface sections until after the other blade portions have encountered their respective cleaning surface sections. In this manner, cross-contamination of wiper blade portions with ink sprayed from their adjacent wiper blade portions is reduced. FIG. 27C provides a front view of wiper blade 46 as it encounters wiper blade cleaner 69 for cleaning. In FIG. 27C it can be seen that middle blade portion 168 passes through wiper blade cleaner 69 without being cleaned. In this fashion, a wiper blade cleaner is provided which effectively cleans the other blade portions of wiper blade 46 without resulting in cross-contamination caused by ink which is scraped off and which may become airborne during cleaning of each of the blade portions by wiper blade cleaner 69.

Figure 28:
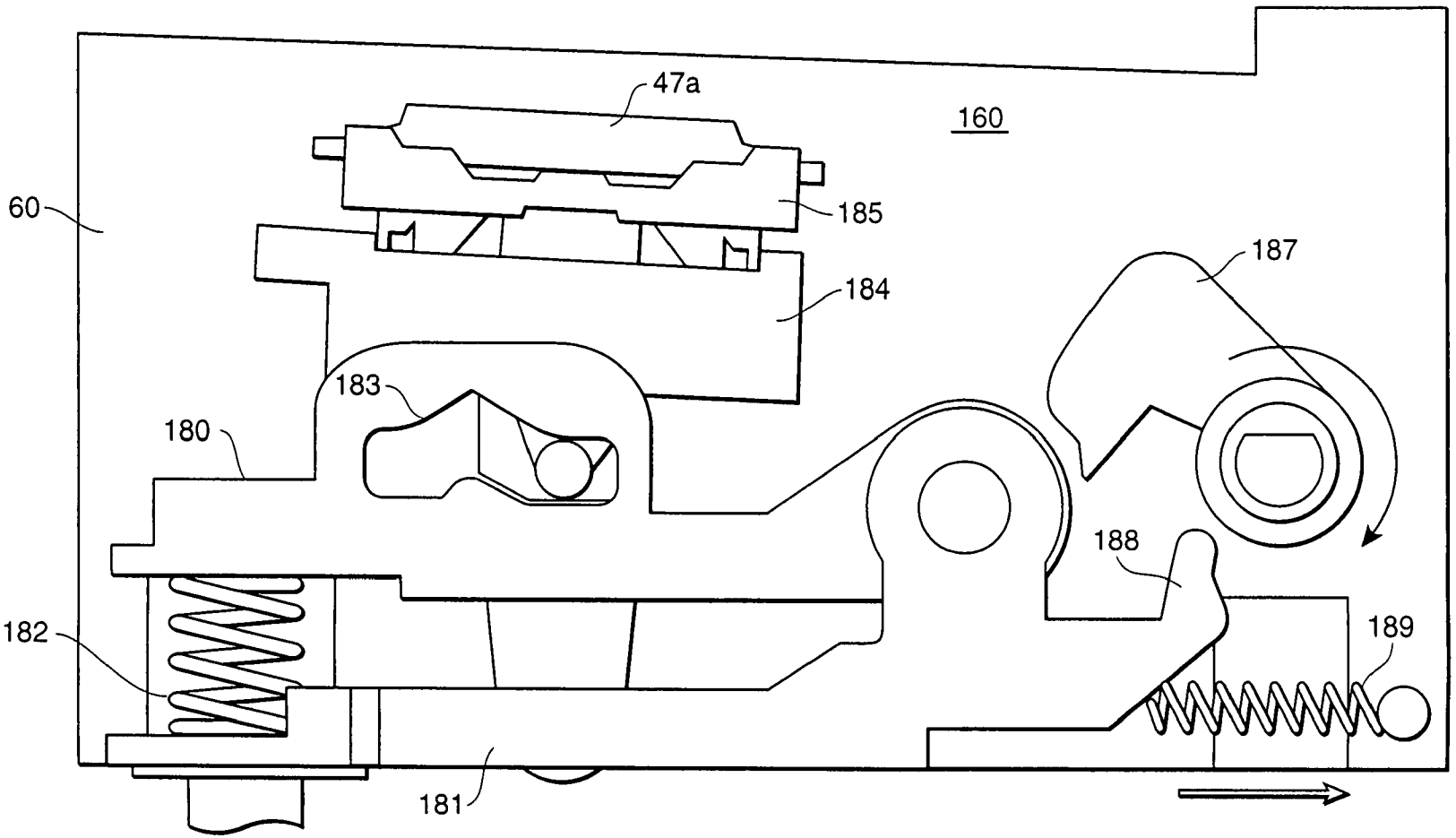
FIG. 28 is a view for explaining the capping mechanism in a lowered state according to one embodiment of the present invention.

FIG. 28 is a view for explaining the capping mechanism to raise and lower caps 47*a* and 47*b*. For the sake of brevity, capping mechanism 160 is explained only with respect to cap 47*a*. As seen in FIG. 28, capping mechanism 160 is comprised of cap lever 180, cap lever support 181 and cap cam 187. Cap lever support 181 is pivotally mounted on recovery mechanism 60 immediately below cap lever 180 which is also pivotally mounted on recovery mechanism 60. Cap lever support 181 has a cap cam following portion 188 which is engaged by cap cam 187 as cap cam 187 revolves in a clockwise direction. When the extended surface of cap cam 187 encounters cap cam following portion 188, cap lever support 181 is rotated in a clockwise direction and therefore raised vertically in an upward direction. Cap lever support 181 is connected to cap lever 180 at distant ends thereof by cap lever spring 182. In this manner, when cap lever support 181 is rotated in an upward direction, spring 182 biases cap lever 180 in an upward direction also. Cap lever 180 has a cap guide 183 which is comprised of a slot in which cap base 184 is supported by a pin formed on cap base 184.

Accordingly, as cap lever 180 is rotated upward in a clockwise direction, cap guide 183 allows cap base 184 to translate upward in a vertical direction. Cap holder 185 is disposed on cap base 184 and is used to hold cap 47*a*. Cap 47*a* is preferably made of rubber or another type of resilient material. Cap 47*a* is connected to a pump tube (not shown) via cap base 184. Cap lever return spring 189 is connected at one end to recovery mechanism 60 and at another end to cap lever support 181 so as to bias cap lever support 181 and cap lever 180 in a lowered state when they are not being driven upward by cap cam 187. As seen in FIG. 28, cap cam 187 is not encountering cap cam following portion 188, and therefore cap lever 180 is biased to be maintained in a lowered state so as to lower cap base 184 and ultimately cap 47*a*, thereby preventing cap 47*a* from coming into contact with print heads 56*a* and 56*b* in an undesired fashion.

Figure 29:
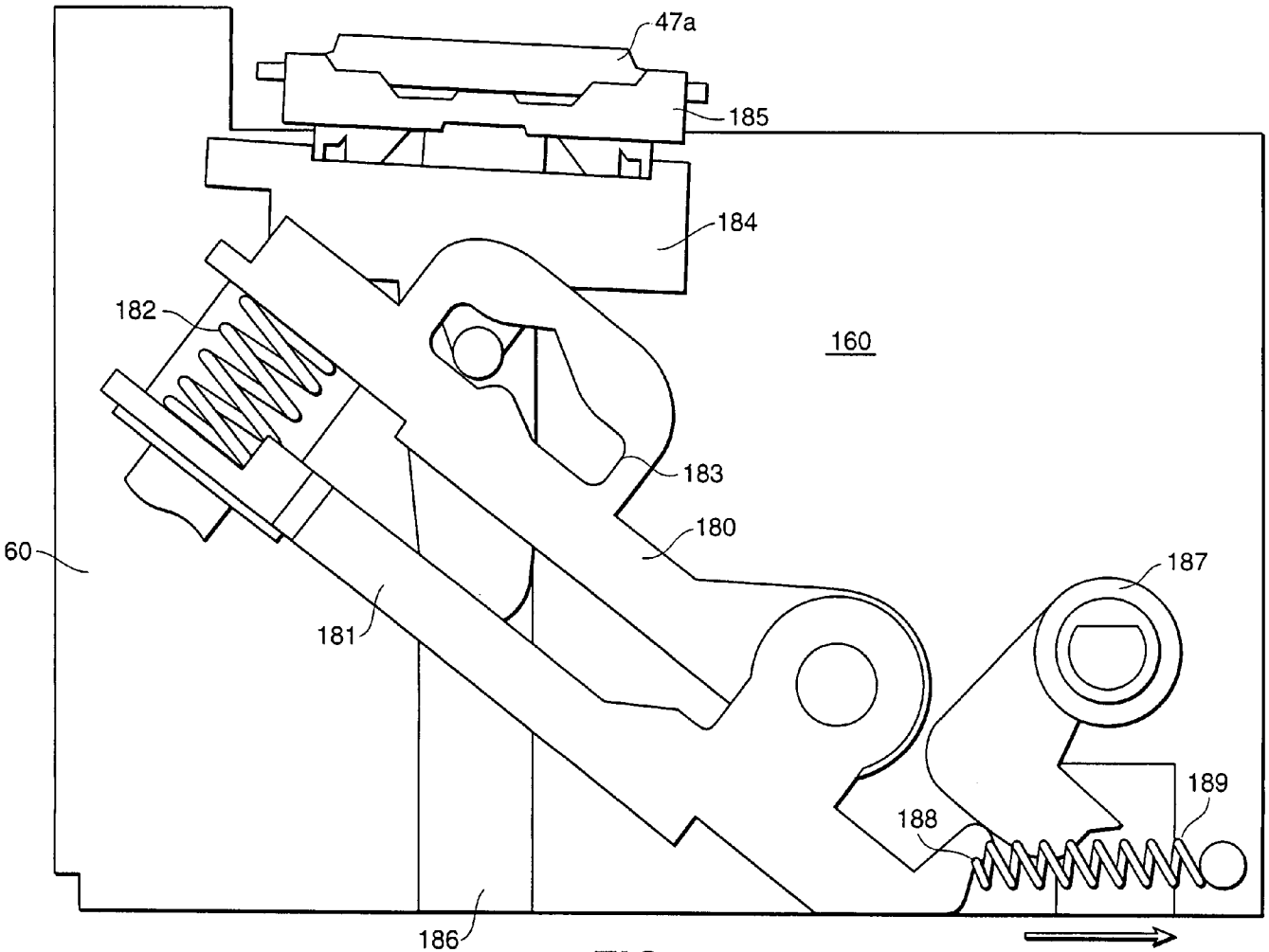
FIG. 29 is a view for explaining the capping mechanism in a raised state according to one embodiment of the present invention.

FIG. 29 provides a view of capping mechanism 160 in a raised state. Specifically, the extended portion of cap cam 187 is disposed against cap cam following portion 188 so as to force cap lever support 181 and cap lever 180, via cap lever spring 182, in an upward direction. Therefore, cap base 184 is translated in an upward direction with assistance from vertical guide rail 186. Vertical guide rail 186 is provided in recovery mechanism 60 in order to restrain the movement of cap base 184 in a vertical direction as cap lever 180 is rotated upward. In this manner, cap holder 185 and cap 47*a* are raised to engage the respective print head with sufficient force to form a seal against the print head, but without using such force as would harm the discharge surface or other component of the print head or cap. This is because cap lever spring 182 is designed to absorb excessive force which may be urged by cap lever support 181 against cap lever 180 during the translation of cap 47*a* toward the respective print head in a capping operation.

Figure 30:
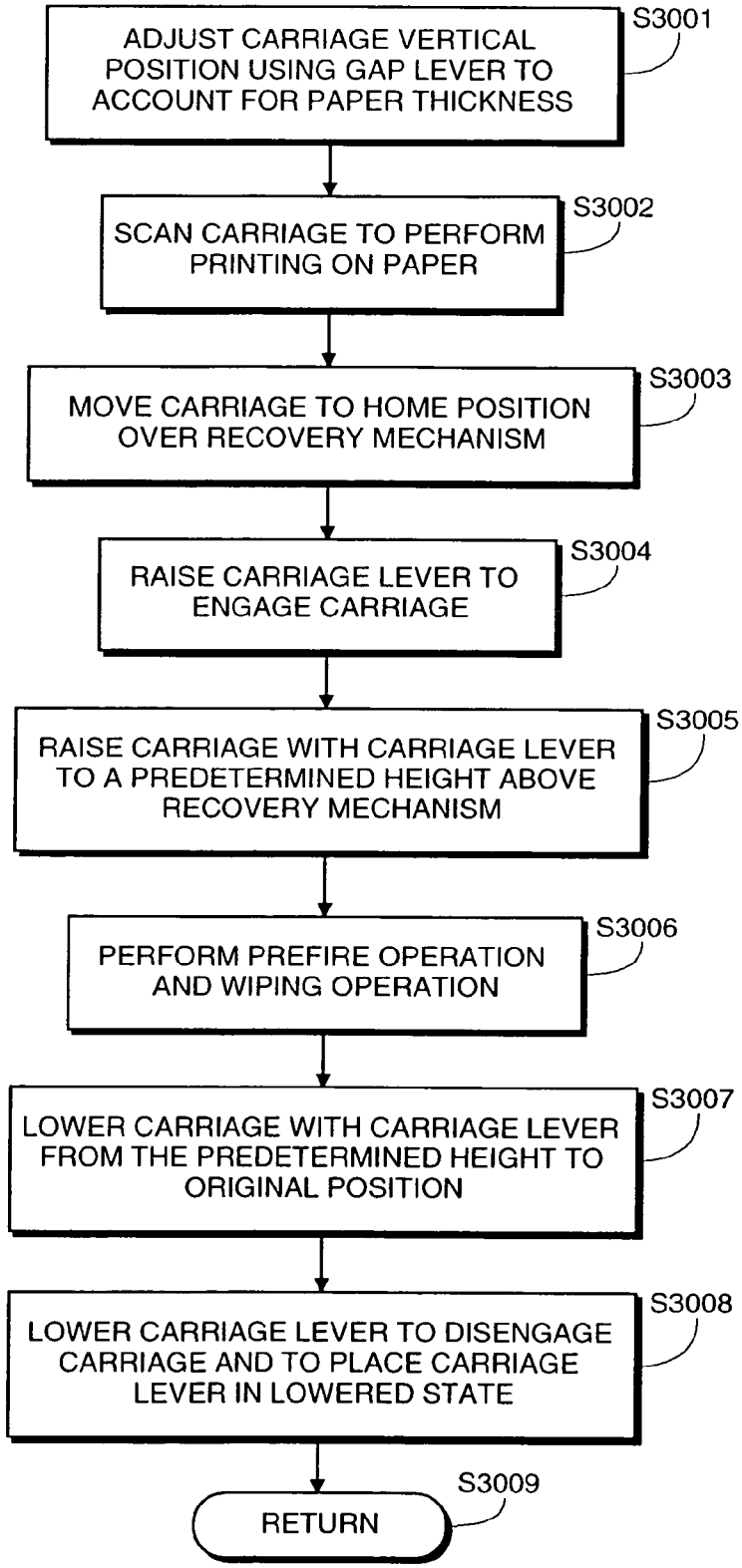
FIG. 30 is a flowchart for explaining operation of a carriage lever according to one embodiment of the present invention.

FIG. 30 is a flowchart for describing the operation of carriage lever 64. Initially, in step S3001, carriage 45 is adjusted to a vertical position using gap lever 150 to account for paper thickness. Then, carriage 45 is scanned across the paper to perform printing on the paper (step S3002). When printing is complete, or when a recovery operation is necessary, carriage 45 is moved to the home position over recovery mechanism 60 in step S3003. Once in the home position, carriage lever 64 is raised using shift cam 145 and carriage lever support 65 (step S3004). Carriage lever 64 then raises carriage 45 to a predetermined height above recovery mechanism 60 for performing recovery operations (step S3005). In this regard, prefire and wiping operations are performed to recover the good condition of printing to print heads 56*a* and 56*b* in step S3006. Carriage lever 64 then lowers carriage 45 in step S3007 from the predetermined height above recovery mechanism 60 to the original position of carriage 45. Lastly, carriage lever 64 is lowered further to disengage carriage 45 and to place carriage lever 64 in a lowered state (step S3008). Control then passes to return in step S3009.

Figure 31:
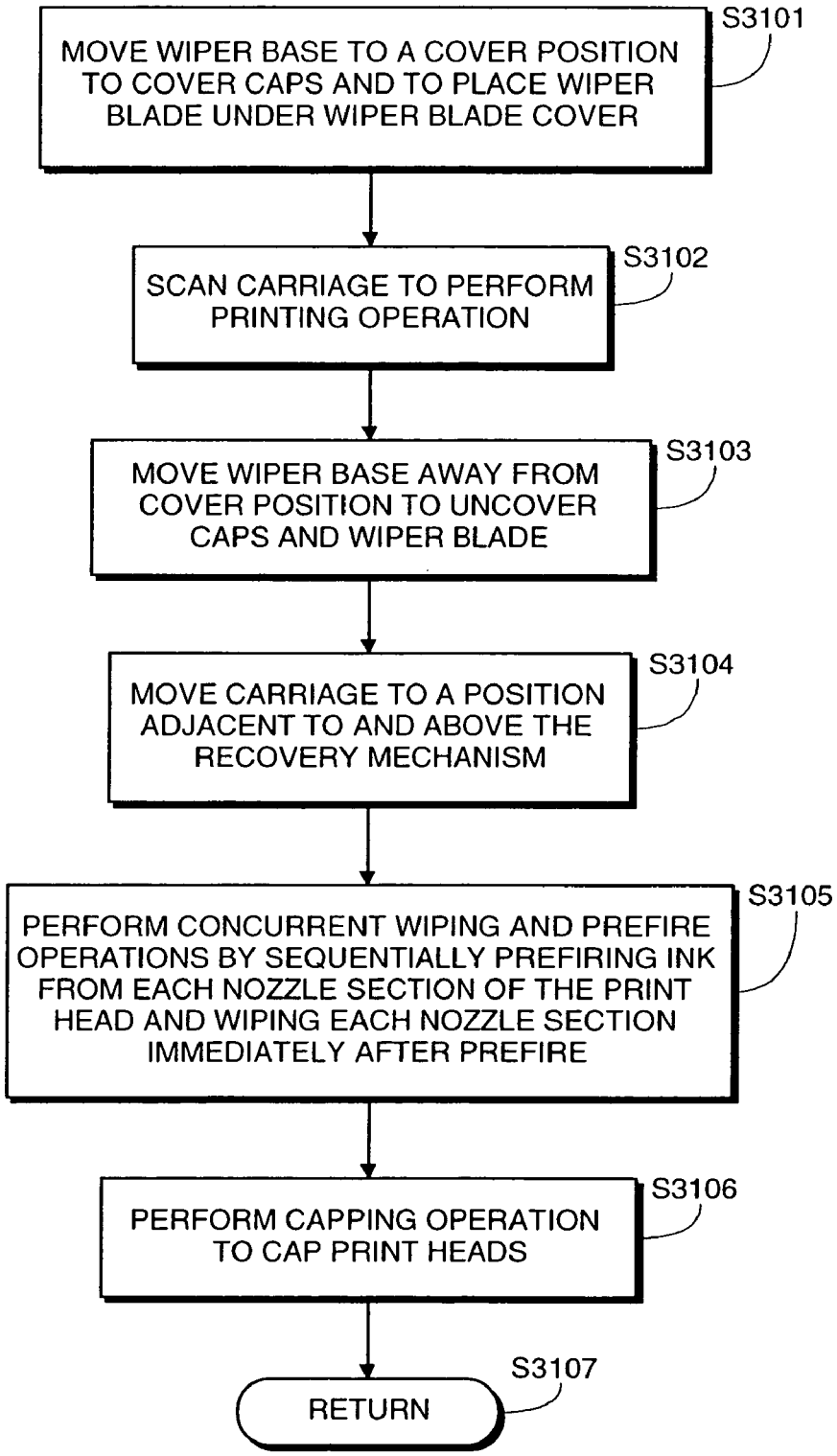
FIG. 31 is a flowchart for explaining the covering of the caps and wiper blade according to one embodiment of the present invention.

FIG. 31 is a flowchart for explaining the covering of caps 47*a* and 47*b* and wiper blade 46 to reduce contamination thereof during a printing operation or during prefire activity. In step S3101, wiper base 62 is moved to a cover position in which wiper base top surface covers caps 47*a* and 47*b* and in which wiper blade 46 is positioned underneath wiper blade cover 66. Next, in step S3102, carriage 45 is scanned to perform printing on a printing medium. Wiper base 62 is then moved away from the cover position to uncover caps 47*a* and 47*b* and wiper blade 46 in step S3103. After printing, carriage 45 is moved to a home position which is adjacent to and above recovery mechanism 60 (step S3104). In step S3105, wiping and prefire operations are performed concurrently by sequentially prefiring ink from each nozzle section of the print heads and then sequentially wiping each nozzle section soon after it has prefired ink, thereby resulting in efficient cleaning of the discharge nozzles of the print heads and performing prefire operations directly over recovery mechanism 60 with reduced contamination to caps 47*a* and 47*b* and wiper blade 46. A capping operation is then performed in step S3106 to cap print heads 56*a* and 56*b* until their next use. Control then passes to return in step S3107.

Figure 32:
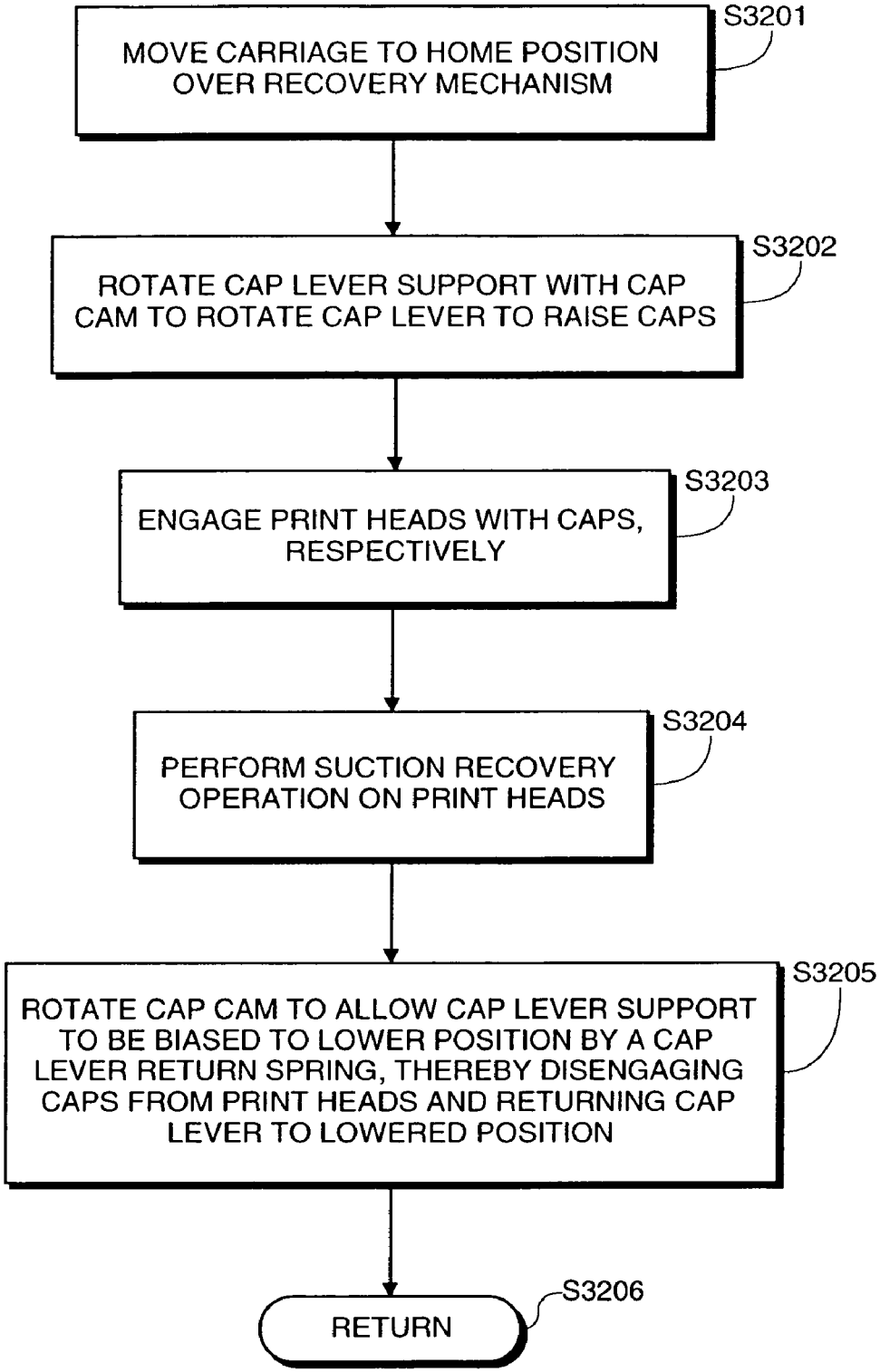
FIG. 32 is a flowchart for explaining the use of the capping mechanism according to one embodiment of the present invention.

FIG. 32 is a flowchart for explaining the operation of capping mechanism 160. In step S3201, carriage 45 is moved to the home position over recovery mechanism 60. Next, cap lever support 181 is rotated via cap cam 187 to rotate cap lever 180, thereby raising caps 47*a* and 47*b* (step S3202). In step S3203, caps 47*a* and 47*b* are raised further to engage print heads 56*a* and 56*b*, respectively. Suction recovery is then performed on the print heads by utilizing pump 52 which is connected to caps 47*a* and 47*b* (step S3204). When the suction recovery operation is completed, cap cam 187 is rotated to allow cap lever support 181 to be biased by cap lever return spring 189, thereby pulling cap lever support 181 and cap lever 180 to a lowered position after disengaging from print heads 56*a* and 56*b* (step S3205). Control then passes to return in step S3206.

Figure 33:
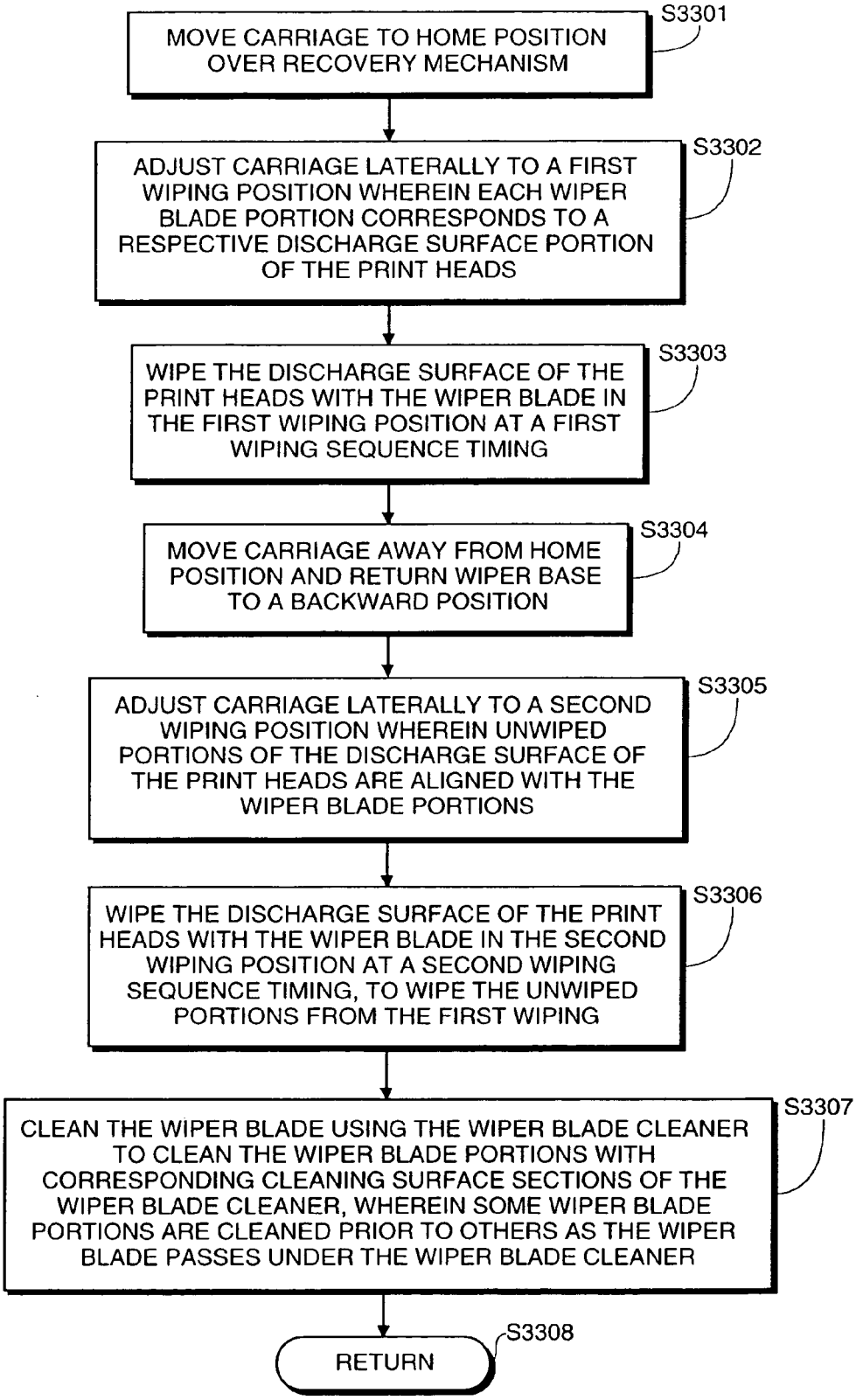
FIG. 33 is a flowchart for explaining a wiping operation according to one embodiment of the present invention.

FIG. 33 is a flowchart to explain the use of wiper blade 46 in the present invention. When a wiping counter in printer controller 100 is accumulated by each wiping, and matches with a first predetermined number, the first wiping position sequence will be executed. Initially, carriage 45 is moved to the home position over recovery mechanism 60 in step S3301. Next, carriage 45 is adjusted in the lateral direction to a first wiping position wherein each wiper blade portion of wiper blade 46 corresponds to a respective discharge surface portion of print heads 56*a* and 56*b* (step S3302). In step S3303, a discharge surface of print heads 56*a* and 56*b* are wiped with wiper blade 46 in the first wiping position. After the first wiping, carriage 45 is moved outside of recovery mechanism 60 and wiper base 62 is moved from over caps 47*a* to a backward position for a next wiping (step S3304). When a wiping counter in printer controller 100 is accumulated by each wiping, and matches with a second predetermined number, the second wiping position sequence will be executed after the first wiping (S3305). Carriage 45 is adjusted laterally to a second wiping position wherein unwiped portions of the discharge surface of print heads 56*a* and 56*b* are now aligned with the wiper blade portions of wiper blade 46 (step S3305). In step S3306, the discharge surface of print heads 56*a* and 56*b* are wiped with wiper blade 46 in the second wiping position, thereby wiping the unwiped portions remaining after the first wiping. After completion of the second wiping, wiper blade 46 is cleaned using wiper blade cleaner 69 to clean the wiper blade portions of wiper blade 46 with corresponding cleaning surface sections 175 of wiper blade cleaner 69 (step S3307). Cleaning surface sections 175 of wiper blade cleaner 69 are staggered so that some wiper blade portions of wiper blade 46 are cleaned prior to other wiper blade portions as wiper blade 46 passes under wiper blade cleaner 69. Control then passes to return in step S3308.

Figure 34:
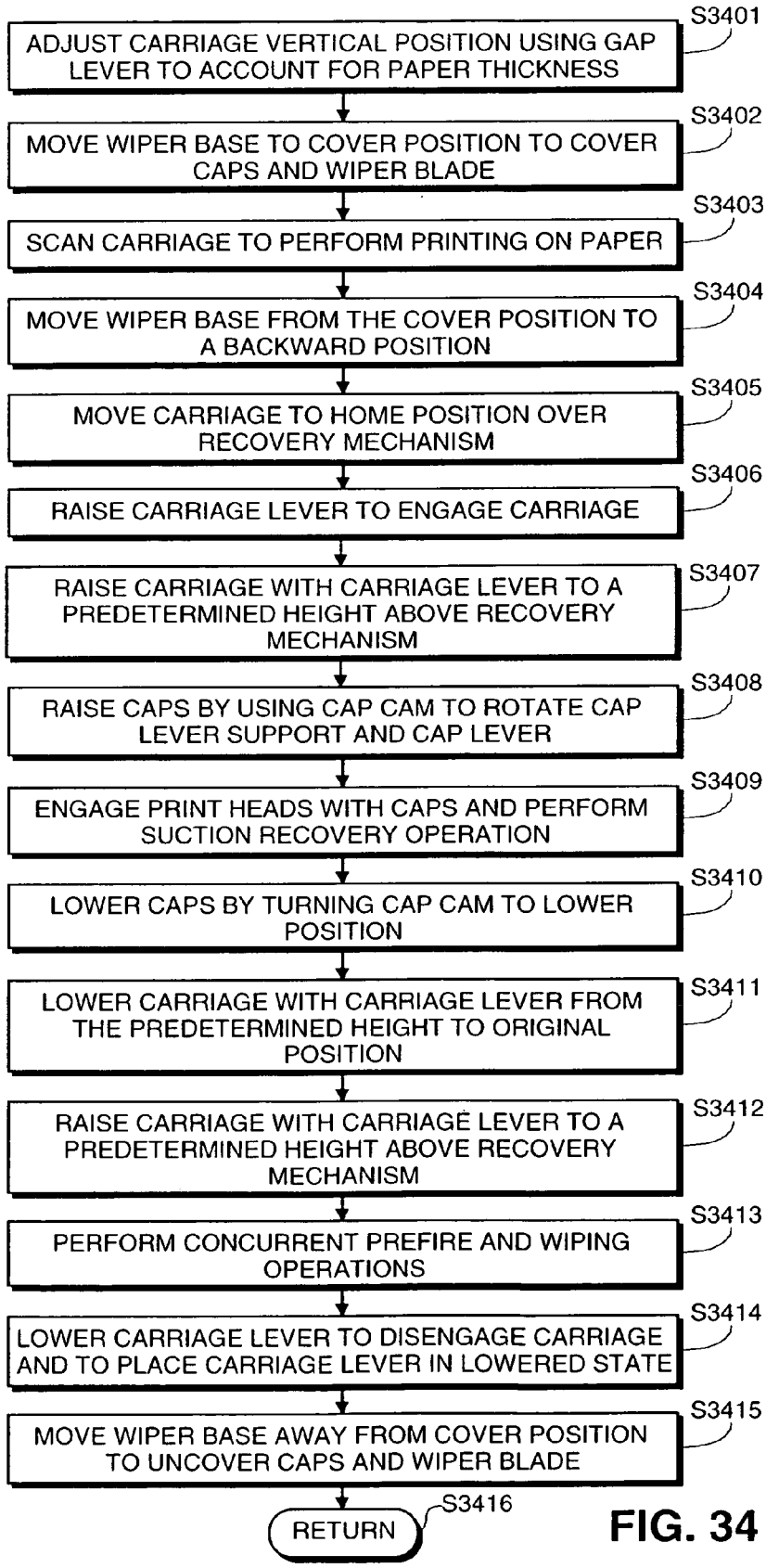
FIG. 34 is a flowchart for explaining a recovery operation sequence according to one embodiment of the present invention.

FIG. 34 is a flowchart for explaining a recovery operation sequence according to one embodiment of the invention. In step S3401, carriage 45 is adjusted to a desired vertical position using gap lever 150 to account for paper thickness during printing. Wiper base 62 is then moved to the cover position to cover caps 47*a* and 47*b* and wiper blade 46 (step S3402). Carriage 45 is then scanned to perform printing on the paper in step S3403. Wiper base 62 is then moved away from the cover position to uncover caps 47*a* and 47*b* in step S3404. Carriage 45 is then moved to the home position over recovery mechanism in step S3405. Once at the home position, carriage lever 64 is raised to engage carriage 45 (step S3406). Carriage lever 64 then raises carriage 45 to a predetermined height above recovery mechanism 60 for optimal performance of recovery operations (step S3407).

Caps 47*a* and 47*b* are then raised by using cap cam 187 to rotate cap lever support 181 and cap lever 180 (step S3408). Caps 47*a* and 47*b* then engage print heads 56*a* and 56*b*, respectively, and perform a suction recovery operation using pump 52 (step S3409). In step S3410, caps 47*a* and 47*b* are lowered by turning cap cam 187 to a lower position. Carriage 45 is then lowered to its original position from the predetermined height with carriage lever 64 (step S3411). Carriage lever 64 then raises carriage 45 to the predetermined height over recovery mechanism (step S3412). In step S3413, concurrent prefire and wiping operations are performed as previously described to achieve optimal cleaning of the discharge surface and discharge nozzles of print heads 56*a* and 56*b*. Carriage lever 64 is then further lowered to disengage carriage 45 and to place carriage lever 64 in a lowered state so as to be out of the travel path of carriage 45 (step S3414). Wiper base 62 is moved away from the cover position in step S3415 in order to uncover caps 47*a* and 47*b* and wiper blade 46. Control then passes to return in step S3416.

The invention has been described with particular illustrative embodiments. It is to be understood that the invention is not limited to the above-described embodiments and that various changes and modifications may be made by those of ordinary skill in the art without departing from the spirit and scope of the invention.

What is claimed is:

1. A printing device for performing recording on a recording medium, the printing device comprising:

a carriage slidably mounted on the printing device in a first lateral direction to scan the recording medium;

a print head mounted on the carriage, the print head having a discharge surface with a first set of discharge nozzles and a second set of discharge nozzles located therein, each set of discharge nozzles for ejecting a different type of ink on the recording medium; and a recovery mechanism for performing recovery of the print head when the carriage is positioned above the recovery mechanism, the recovery mechanism including a first cap and a second cap to cap the first and second sets of discharge nozzles, respectively, a wiper blade mounted on a wiper base, the wiper base being slidably mounted on the recovery mechanism to wipe the discharge surface of the print head with the wiper blade and to cover the caps when the caps are not capping the print head, and a wiper blade cover mounted on the recovery mechanism to cover the wiper blade when the wiper blade is not wiping the print head.

2. A printing device according to claim 1, wherein the wiper base is slidably mounted so as to be movable in a second lateral direction which is perpendicular to the first lateral direction of the carriage.

3. A printing device according to claim 2, wherein the wiper base is moved in the second lateral direction to wipe the print head by a wiper transmission mechanism which is driven by a motor.

4. A printing device according to claim 1, wherein the wiper base has a top surface which covers and protects the first and second caps from ink ejected from the print head when the wiper base is positioned to cover the caps.

5. A printing device according to claim 4, wherein the wiper base includes a first prefire area and a second prefire area disposed on the wiper base top surface for receiving ink ejected from the first and second sets of discharge nozzles, respectively, during a prefire recovery operation.

6. A printing device according to claim 5, wherein the first and second prefire areas each contain a drain sheet for retaining the received ink.

7. A printing device according to claim 5, wherein the first prefire area is located away from the location of the first and second caps, and has an opening for draining the received ink to an area of the printing device located below the wiper base.

8. A printing device according to claim 7, wherein the second prefire area contains a drain sheet for retaining the received ink.

9. A printing device according to claim 5, wherein the wiper blade is mounted at a position on the wiper base which crosses the first and second prefire areas.

10. A printing device according to claim 5, wherein the wiper blade wipes the first and second sets of discharge nozzles during the prefire recovery operation.

11. A printing device according to claim 10, wherein each of the first and second sets of discharge nozzles are arranged in a plurality of nozzle sections in the second lateral direction, each nozzle section including a plurality of discharge nozzles, and wherein, during a prefire recovery operation, each nozzle section of discharge nozzles successively ejects ink and is wiped by the wiper blade as the wiper base moves in the second lateral direction under the print head, the ejected ink from the first and second sets of discharge nozzles being received in the first and second prefire areas, respectively.

12. A printing device according to claim 1, wherein the wiper blade cover has a top surface which covers and protects the wiper blade from ink ejected from the print head when the wiper base is positioned to cover the caps.

13. A method in a printing device which performs recording on a recording medium, the printing device including a carriage slidably mounted on the printing device in a first lateral direction to scan the recording medium, a print head mounted on the carriage, the print head having a discharge surface with a first set of discharge nozzles and a second set of discharge nozzles located therein, each set of discharge nozzles for ejecting a different type of ink on the recording medium, the method comprising the steps of:

moving a wiper base in a recovery mechanism to a cover position in which the wiper base covers a first cap and a second cap provided in the recovery mechanism, the wiper base having a wiper blade mounted thereon, the wiper blade being covered by a wiper blade cover when the wiper base is at the cover position;

ejecting ink from the first and second sets of discharge nozzles while scanning the print head in the first lateral direction to record an image on the recording medium;

moving the print head to a position adjacent to the recovery mechanism; and moving the wiper base away from the cover position to uncover the first and second caps and the wiper blade for performing one of a capping operation and a wiping operation of the print head.

14. A method according to claim 13, wherein the wiper base is slidably mounted so as to be movable in a second lateral direction which is perpendicular to the first lateral direction of the carriage.

15. A method according to claim 14, wherein the wiper base is moved in the second lateral direction to wipe the print head by a wiper transmission mechanism which is driven by a motor.

16. A method according to claim 13, wherein the wiper base has a top surface which covers and protects the first and second caps from ink ejected from the print head when the wiper base is positioned to cover the caps.

17. A method according to claim 16, wherein the wiper base includes a first prefire area and a second prefire area disposed on the wiper base top surface for receiving ink ejected from the first and second sets of discharge nozzles, respectively, during a prefire recovery operation.

18. A method according to claim 17, wherein the first and second prefire areas each contain a drain sheet for retaining the received ink.

19. A method according to claim 17, wherein the first prefire area is located away from the location of the first and second caps, and has an opening for draining the received ink to an area of the printing device located below the wiper base.

20. A method according to claim 19, wherein the second prefire area contains a drain sheet for retaining the received ink.

21. A method according to claim 17, wherein the wiper blade is mounted at a position on the wiper base which crosses the first and second prefire areas.

22. A method according to claim 17, wherein the wiper blade wipes the first and second sets of discharge nozzles during the prefire recovery operation.

23. A method according to claim 22, wherein each of the first and second sets of discharge nozzles are arranged in a plurality of nozzle sections in the second lateral direction, each nozzle section including a plurality of discharge nozzles, and wherein, during a prefire recovery operation, each nozzle section of discharge nozzles successively ejects ink and is wiped by the wiper blade as the wiper base moves in the second lateral direction under the print head, the ejected ink from the first and second sets of discharge nozzles being received in the first and second prefire areas, respectively.

24. A method according to claim 13, wherein the wiper blade cover has a top surface which covers and protects the wiper blade from ink ejected from the print head when the wiper base is positioned to cover the caps.

* * * * *